US009776047B2

(12) United States Patent
Krysiak et al.

(10) Patent No.: US 9,776,047 B2
(45) Date of Patent: Oct. 3, 2017

(54) AMERICAN-STYLE FOOTBALL INCLUDING ELECTRONICS COUPLED TO THE BLADDER

(71) Applicant: Wilson Sporting Goods Co., Chicago, IL (US)

(72) Inventors: Kevin L Krysiak, Palatine, IL (US); Douglas G. Guenther, Wheaton, IL (US); Bradley L. Gaff, Woodridge, IL (US); Mark W. Fisher, Findlay, OH (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 14/495,225

(22) Filed: Sep. 24, 2014

(65) Prior Publication Data

US 2015/0011343 A1 Jan. 8, 2015

Related U.S. Application Data

(63) Continuation of application No. 12/947,920, filed on Nov. 17, 2010, now Pat. No. 8,870,689.

(Continued)

(51) Int. Cl.

*A63B 43/00* (2006.01)
*A63B 41/02* (2006.01)

(Continued)

(52) U.S. Cl.

CPC ..... *A63B 43/004* (2013.01); *A63B 24/0006* (2013.01); *A63B 41/02* (2013.01); *A63B 41/08* (2013.01); *A63B 45/00* (2013.01); *A63B 2102/14* (2015.10); *A63B 2102/18* (2015.10); *A63B 2102/182* (2015.10); *A63B 2220/12* (2013.01); *A63B 2220/13* (2013.01); *A63B 2220/20* (2013.01); *A63B 2220/30* (2013.01);

(Continued)

(58) Field of Classification Search

CPC ..... A63B 41/02; A63B 41/08; A63B 43/004; A63B 2225/50; A63B 2243/007; A63B 2243/0066; A63B 2243/0025

See application file for complete search history.

(56) References Cited

U.S. PATENT DOCUMENTS 495,863 A 4/1893 Whitzel
996,458 A 6/1911 Coleman (Continued)

FOREIGN PATENT DOCUMENTS

EP 1866039 7/2006
EP 1909925 7/2006

(Continued)

*Primary Examiner* — Steven Wong
(74) *Attorney, Agent, or Firm* — Terence P. O'Brien

(57) ABSTRACT

An American style football including an inflatable prolate spheroidal shaped bladder, at least one cover panel surrounding the bladder, a lacing coupled to the at least one cover panel, a flap and an electronic circuit. The flap is coupled to the outer surface of the bladder and is generally positioned to align with the lacing. The electronic circuit is positioned on or beneath the flap. The electronic circuit includes at least one sensor and the electronic circuit is configured to produce a signal to enable at least one characteristic of the football to be monitored during use.

20 Claims, 25 Drawing Sheets

Related U.S. Application Data

(60) Provisional application No. 61/262,586, filed on Nov. 19, 2009.

(51) Int. Cl.

| | |
|---|---|
| ***A63B 41/08*** | (2006.01) |
| ***A63B 24/00*** | (2006.01) |
| ***A63B 45/00*** | (2006.01) |
| *A63B 102/14* | (2015.01) |
| *A63B 102/18* | (2015.01) |

(52) U.S. Cl.

CPC ..... *A63B 2220/35* (2013.01); *A63B 2220/40* (2013.01); *A63B 2220/51* (2013.01); *A63B 2220/56* (2013.01); *A63B 2220/72* (2013.01); *A63B 2220/89* (2013.01); *A63B 2225/20* (2013.01); *A63B 2225/50* (2013.01); *A63B 2225/52* (2013.01); *A63B 2225/54* (2013.01); *A63B 2243/007* (2013.01); *A63B 2243/0025* (2013.01); *A63B 2243/0037* (2013.01); *A63B 2243/0066* (2013.01); *A63B 2243/0095* (2013.01)

(56) References Cited

U.S. PATENT DOCUMENTS 1,002,928 A * 9/1911 Pierce ..... A63B 41/08 473/599
1,621,898 A * 3/1927 Pierce ..... A63B 41/085 473/599
2,020,484 A 11/1935 Turner
2,849,819 A 9/1958 Murphy et al.
2,903,820 A 9/1959 Bodell
3,011,048 A 11/1961 O'Brien
3,229,976 A 1/1966 Allen, Jr.
3,304,651 A 2/1967 Deyerl
3,458,205 A 7/1969 Smith et al.
3,580,575 A 5/1971 Speeth
3,610,916 A 10/1971 Meehan
3,616,165 A 10/1971 Nishi
3,804,411 A 4/1974 Hendry
4,002,893 A 1/1977 Newcomb et al.
4,133,528 A 1/1979 Koblick
4,479,649 A 10/1984 Newcomb et al.
4,577,865 A 3/1986 Shishido
4,660,831 A 4/1987 Kralik
4,701,146 A 10/1987 Swenson
4,776,589 A 10/1988 Yang
4,963,117 A 10/1990 Gualdoni
5,054,778 A 10/1991 Maleyko
5,066,011 A 11/1991 Dykstra et al.
5,066,012 A 11/1991 Stark
5,080,359 A 1/1992 Thill
5,098,097 A * 3/1992 Kennedy ..... A63B 41/00 473/599
5,102,131 A 4/1992 Remington et al.
5,186,458 A 2/1993 Redondo
5,228,686 A 7/1993 Maleyko
5,236,383 A 8/1993 Connelly
5,388,825 A 2/1995 Myers et al.
5,403,000 A 4/1995 Woosley
5,480,144 A 1/1996 Downing
5,564,702 A 10/1996 Meffert
5,609,411 A 3/1997 Wang
5,639,076 A 6/1997 Cmiel et al.
5,683,316 A 11/1997 Campbell
5,725,445 A 3/1998 Kennedy et al.
5,755,634 A 5/1998 Huang
5,882,204 A 3/1999 Iannazo et al.
5,888,156 A 3/1999 Cmiel et al.
5,976,038 A 11/1999 Orenstein et al.
6,142,894 A 11/2000 Lee
6,251,035 B1 6/2001 Fa
6,398,616 B1 6/2002 Motosko, III
6,416,327 B1 7/2002 Wittenbecher
6,428,432 B1 8/2002 Kachel
6,537,125 B1 3/2003 Motosko, III
6,702,292 B2 3/2004 Takowsky
6,726,580 B2 4/2004 Peterson
7,014,581 B2 3/2006 Ng
7,179,181 B2 2/2007 Ko
7,273,431 B2 * 9/2007 DeVall ..... A63B 43/00 473/570
7,719,469 B2 5/2010 Englert et al.
7,727,097 B2 6/2010 Siegel et al.
7,740,551 B2 6/2010 Nurnberg et al.
7,795,861 B2 9/2010 Englert et al.
7,811,163 B2 10/2010 Ratcliffe
7,867,113 B2 1/2011 Petersen
7,867,115 B2 1/2011 Zawitz
7,891,666 B2 2/2011 Kuenzler et al.
7,915,887 B2 3/2011 Englert et al.
7,998,004 B2 8/2011 Klein
8,057,328 B2 11/2011 Englert
8,066,572 B1 11/2011 Timmons et al.
8,079,925 B2 12/2011 Englert et al.
8,172,722 B2 5/2012 Molyneux et al.
8,228,056 B2 7/2012 Bucher
8,231,487 B2 7/2012 Nurnberg et al.
8,231,506 B2 7/2012 Molyneux et al.
8,439,773 B2 5/2013 Silagy
8,506,430 B2 8/2013 Von Der Gruen et al.
8,517,870 B2 8/2013 Crowley et al.
8,535,185 B2 9/2013 Englert
8,540,560 B2 9/2013 Crowley et al.
8,562,487 B2 10/2013 Berggren et al.
8,579,632 B2 11/2013 Crowley
8,597,095 B2 12/2013 Crowley et al.
2003/0054905 A1 3/2003 King, Jr.
2003/0073518 A1 4/2003 Marty et al.
2003/0224885 A1 12/2003 Leal et al.
2005/0049092 A1 3/2005 Lo
2005/0288133 A1 12/2005 Rudell
2005/0288134 A1 12/2005 Smith
2006/0063622 A1 3/2006 Nurnberg et al.
2006/0105857 A1 5/2006 Stark
2007/0026975 A1 2/2007 Marty et al.
2007/0037641 A1 2/2007 Wong
2007/0091084 A1 4/2007 Ueshima et al.
2007/0173355 A1 7/2007 Klein
2007/0178967 A1 8/2007 Rosenberg
2007/0281811 A1 12/2007 Wang
2008/0088303 A1 4/2008 Englert
2008/0174281 A1 7/2008 Shau
2008/0274844 A1 11/2008 Ward
2009/0029754 A1 1/2009 Slocum et al.
2009/0048039 A1 2/2009 Holthouse et al.
2009/0072817 A1 3/2009 Bucher
2009/0191990 A1 7/2009 Smith
2009/0210078 A1 8/2009 Crowley
2010/0035710 A1 2/2010 Smith
2010/0069181 A1 3/2010 Lin
2010/0130314 A1 5/2010 Von Der Gruen et al.
2010/0130315 A1 5/2010 Steidle
2010/0198043 A1 8/2010 Holzer et al.
2010/0222163 A1 9/2010 Eskildsen
2011/0136603 A1 6/2011 Lin et al.
2011/0269517 A1 11/2011 Englert et al.
2011/0287878 A1 11/2011 Englert
2011/0316529 A1 12/2011 Stancil et al.
2012/0029666 A1 2/2012 Crowley et al.
2012/0040785 A1 2/2012 De Sort
2012/0058845 A1 3/2012 Crowley et al.
2012/0071282 A1 3/2012 Smith
2012/0172129 A1 7/2012 Vaananen
2012/0244969 A1 9/2012 Binder
2012/0262329 A1 10/2012 Molyneux et al.
2012/0264549 A1 10/2012 Homsi et al.
2012/0277040 A1 11/2012 Vincent et al.
2013/0023365 A1 1/2013 Idoni-Matthews et al.

(56) References Cited

U.S. PATENT DOCUMENTS

| | | | | |
|---|---|---|---|---|
| 2013/0085006 | A1 | 4/2013 | Nilwong et al. | |
| 2013/0196801 | A1 | 8/2013 | Eskildsen | |
| 2014/0256478 | A1* | 9/2014 | Gale ..... | A63B 43/004<br>473/465 |

FOREIGN PATENT DOCUMENTS

| | | |
|---|---|---|
| EP | 1852155 | 9/2006 |
| WO | 2008043450 | 4/2008 |
| WO | 2008043465 | 4/2008 |
| WO | 2008080626 | 7/2008 |
| WO | 2008104247 | 9/2008 |
| WO | 2008119479 | 10/2008 |
| WO | 2009006931 | 1/2009 |
| WO | 2010054849 | 5/2010 |

* cited by examiner

FIG. 17
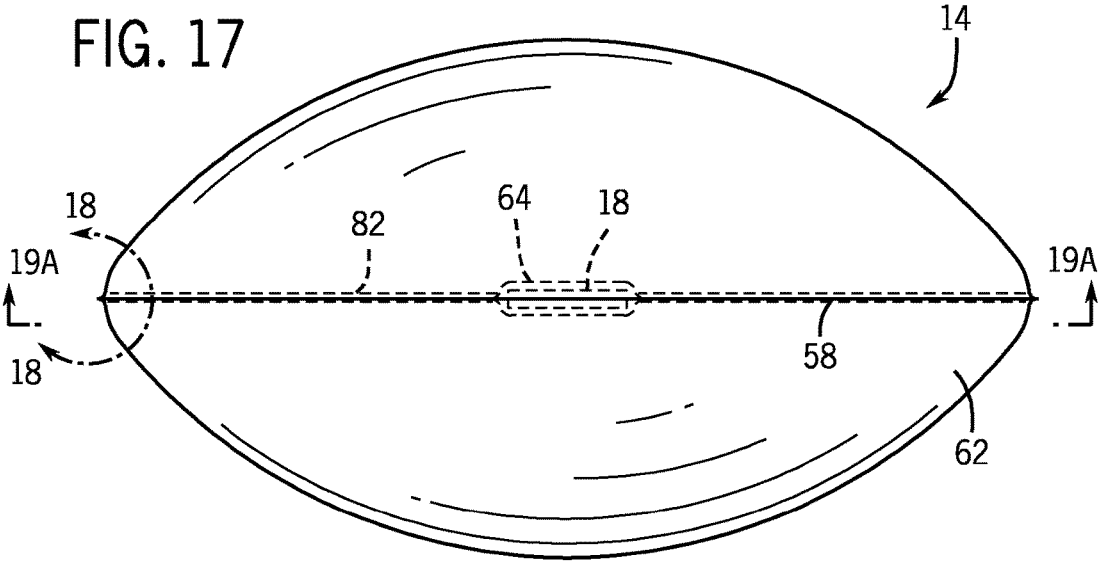
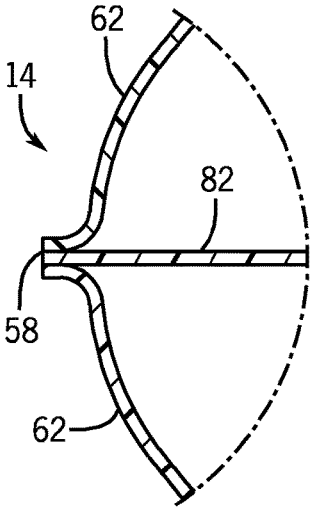
FIG. 18
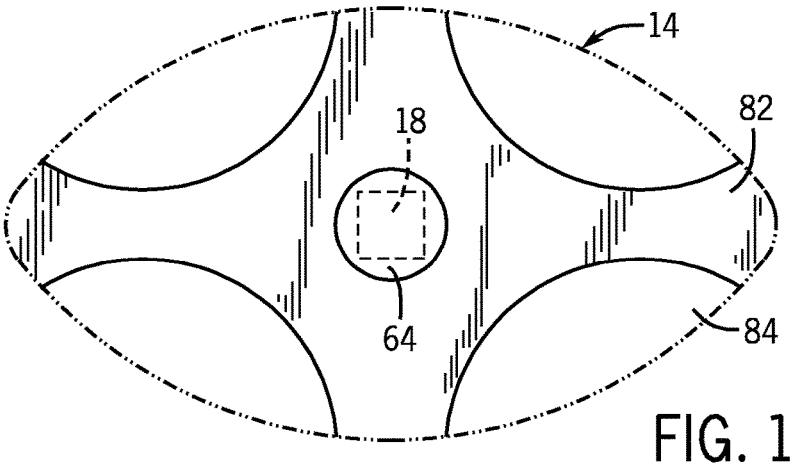
FIG. 19A

AMERICAN-STYLE FOOTBALL INCLUDING ELECTRONICS COUPLED TO THE BLADDER

RELATED U.S. APPLICATION DATA

The present application is a continuation of U.S. patent application Ser. No. 12/947,920 filed on Nov. 17, 2010, which claims the benefit of the filing date under 35 U.S.C. §119(e) of U.S. Provisional Patent Application Ser. No. 61/262,586, filed on Nov. 19, 2009, which is hereby incorporated by reference in its entirety.

FIELD OF THE INVENTION

The present invention relates to an American-style football including electronics for enabling the position, speed, acceleration, deceleration, rotation and movement of the football to be accurately monitored during play.

BACKGROUND OF THE INVENTION

American-style footballs are well known and typically include an inner inflatable air bladder surrounded by an outer cover and enclosed with a lacing. The cover can be formed of one or more cover panels, and most commonly, four cover panels. The lacing is often used to assist in throwing or handling the football.

American football is a fast paced, contact sport typically involving twenty-two players on the football field during play (eleven per team). American football allows for the game ball, typically a generally prolate spheroidal shaped inflatable object, to be moved or repositioned in a large variety of ways during play including being carried, thrown, kicked, pitched, tossed, caught, handed-off, muffed, and fumbled.

The position of a football during a play can be very important information. Organized football games typically include several officials (referees, umpires, head linesmen, line judges, back judges, field judges and side judges) whose primary responsibilities are to monitor play including the position of the football. In recent years, professional football leagues (including the National Football League) and amateur leagues (including the NCAA®) have adopted the use of video replays to assist officials in reviewing disputed calls during the course of a football game. Often the position of a football during the play is the primary issue under dispute. For example, whether the football crossed the goal line of the end zone during a play, or whether a player's forward progress with the football during a play passed the first down marker on the field of play. The goal line is an imaginary plane extending upward from the line of paint at the edge of the end zone (goal line) on the field of play. These decisions or calls by the officials on the field or in the replay booth can be very difficult at times due to line of sight limitations of the officials and/or the cameras used to film the game action.

Further, the players themselves can increase the difficulty of tracking or determining the position of a football during a play. Because football plays involve tackling and blocking, often the players themselves obstruct a clear view of the football during a play. It is also not uncommon for an official to make an incorrect call on a play due to the position of the official during the play and the angle of the official's view of the play itself. Even video replays can result in incorrect decisions or inconclusive evidence based upon the positions of the video cameras taping the football game. Additionally, player's often attempt to reposition and improve the position of the football after the play has been whistled dead or over by the official. In some instances, the official may not detect such late repositioning of the football by a player. An incorrect goal line or first down call can be a determinative factor in the outcome of a football game.

Accordingly, there is an ongoing need to improve the monitoring and observation of the football game action to minimize the occurrences of incorrect decisions by officials, particularly those decisions involving the position of the football during a play.

Video replays have improved the integrity and accuracy of the game official's decisions or calls during a game. However, in many cases, the process of stopping the game to review the video tape evidence of a disputed play can take several minutes. Spectators of football games often find such delays to be too long, boring and/or disruptive to the flow of the game. Many coaches believe a few minute delay to review a disputed call can negatively affect a team's emotional level, and overall momentum. Others believe the time needed to complete a football game in general has been too long, even before the introduction and incorporation of replay reviews of disputed plays.

Therefore, there is also a continuing need for a method or system of more accurately monitoring the football game during play, including the position of the football, without introducing undesirable delays to the football game. Additionally, an ongoing need exists to improve the coverage of a football game itself and to provide more information about various aspects of the game to coaches, officials, players and spectators. It would be desirable to provide detailed information about the movement of a football during a game, such as, for example, the flight of a passed ball, the speed, distance and/or rotation of a passed or kicked football, the exact position of the football during play, whether the football contacted a player, and whether the football was securely maintained by a player.

SUMMARY OF THE INVENTION

The present invention provides an American-style football including an inflatable bladder, a cover surrounding the bladder, and an electronic circuit. The bladder includes first and second side walls defining an expandable cavity and a cross-member configured to extend through the expandable cavity. The side walls and cross-member are coupled together to form a bladder seam. The electronic circuit is coupled to the cross-member and produces a signal to enable the position and movement of the football to be monitored during use.

According to a principal aspect of a preferred form of the invention, an American-style football includes an inflatable bladder, at least one cover panel surrounding the bladder, a lacing coupled to the at least one cover panel, and an electronic circuit. The electronic circuit is coupled to the bladder. The electronic circuit includes at least one sensor and the electronic circuit being configured to produce a signal to enable the position and movement of the football to be monitored during use.

According to another preferred aspect of the invention, an American-style football has an inflatable bladder, at least two cover panels surrounding the bladder, a lacing coupled to the at least one cover panel, and an electronic circuit. Each of the cover panels includes an outermost layer and a lining. The electronic circuit is coupled to at least one of the cover panels. The electronic circuit includes at least one sensor.

The electronic circuit is configured to produce a signal to enable the position and movement of the football to be monitored during use.

According to another preferred aspect of the invention, an American-style football has an inflatable bladder, at least one cover panel surrounding the bladder, and an electronic circuit. The electronic circuit is coupled to one of the bladder and the cover panel. The electronic circuit is a thin, flexible radio frequency identification tag. The electronic circuit is configured to produce a signal to enable the position and movement of the football to be monitored during use.

According to another preferred aspect of the invention, an inflatable game ball includes an inflatable bladder, a cover surrounding the bladder, an electronic circuit coupled to the bladder, and electrical leads. The cover includes a valve assembly. The valve assembly is configured to allow for inflation of the bladder and adapted to receive a charging device. The electronic circuit includes a rechargeable battery. The electronic circuit is configured to produce a signal to enable the position and movement of the game ball to be monitored during use. The electrical leads facilitate the charging of the battery. The electrical leads have first and second ends. The first end is coupled to the rechargeable battery and the second end is coupled to the valve assembly.

This invention will become more fully understood from the following detailed description, taken in conjunction with the accompanying drawings described herein below, and wherein like reference numerals refer to like parts.

BRIEF DESCRIPTION OF THE DRAWINGS

FIG. 17 is a side view of a bladder of a football in accordance with an alternative preferred embodiment of the present invention.

FIG. 18 is a cross-sectional view of a portion of the bladder taken about curved line 18-18 of FIG. 17.

FIG. 19A is a cross-sectional view of the bladder taken about line 19A-19A of FIG. 17.

DETAILED DESCRIPTION OF THE PREFERRED EMBODIMENTS

Figure 1:
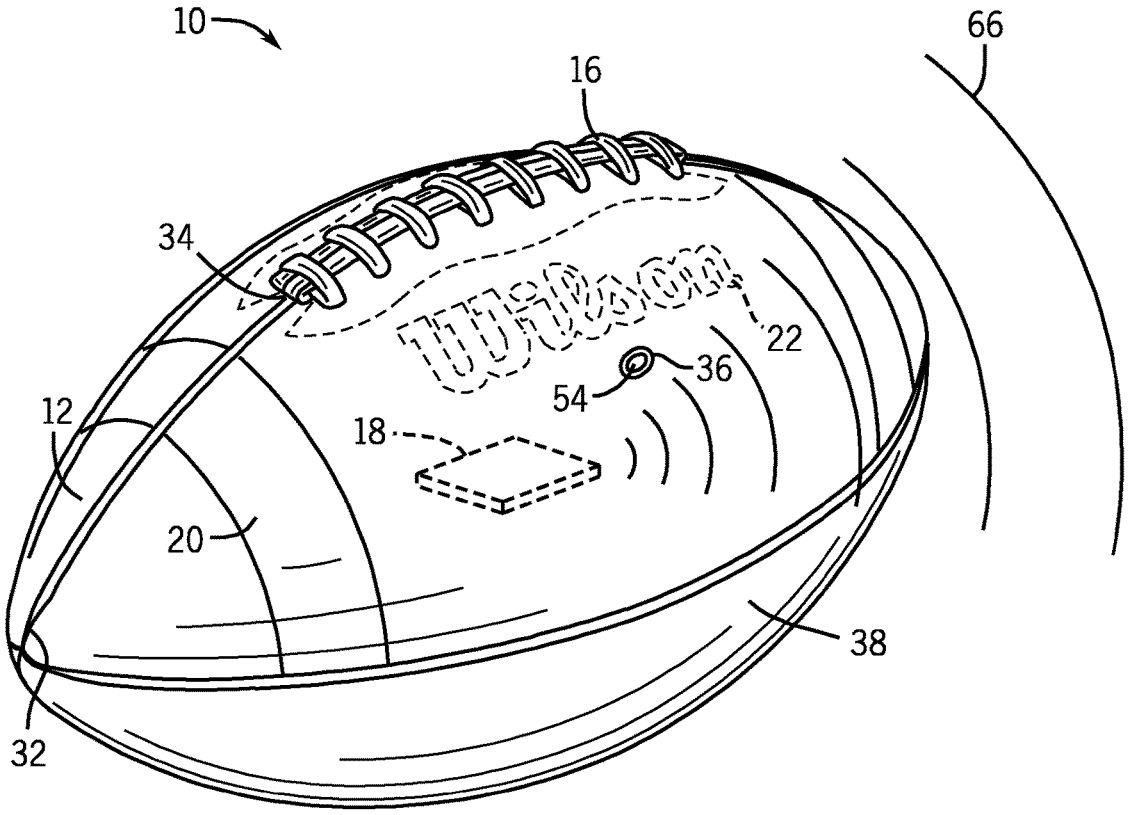
FIG. 1 is a side perspective view of an American football in accordance with a preferred embodiment of the present invention.

Referring to FIG. 1, an American football is indicated generally at 10. The football 10 is one example of an inflatable game ball. The present invention is primarily directed toward American footballs, and many features are unique to American footballs. However, other aspects and features of the present invention are applicable to other sports games, such as, for example, basketballs, volleyballs, soccer balls, baseballs, softballs, lacrosse balls and rugby balls.

The football 10 is a generally prolate spheroidal shaped inflatable object having a major longitudinal dimension and a minor transverse dimension. The football 10 is configured to be grasped, thrown, caught, kicked, and carried by a player during use. The football 10 includes, a cover 12, a bladder 14 (FIG. 2), a lacing 16, and an electronic chip 18. In some embodiments, the football 10 can also include a plurality of stripes 20 and one or more logos 22.

Figure 2:
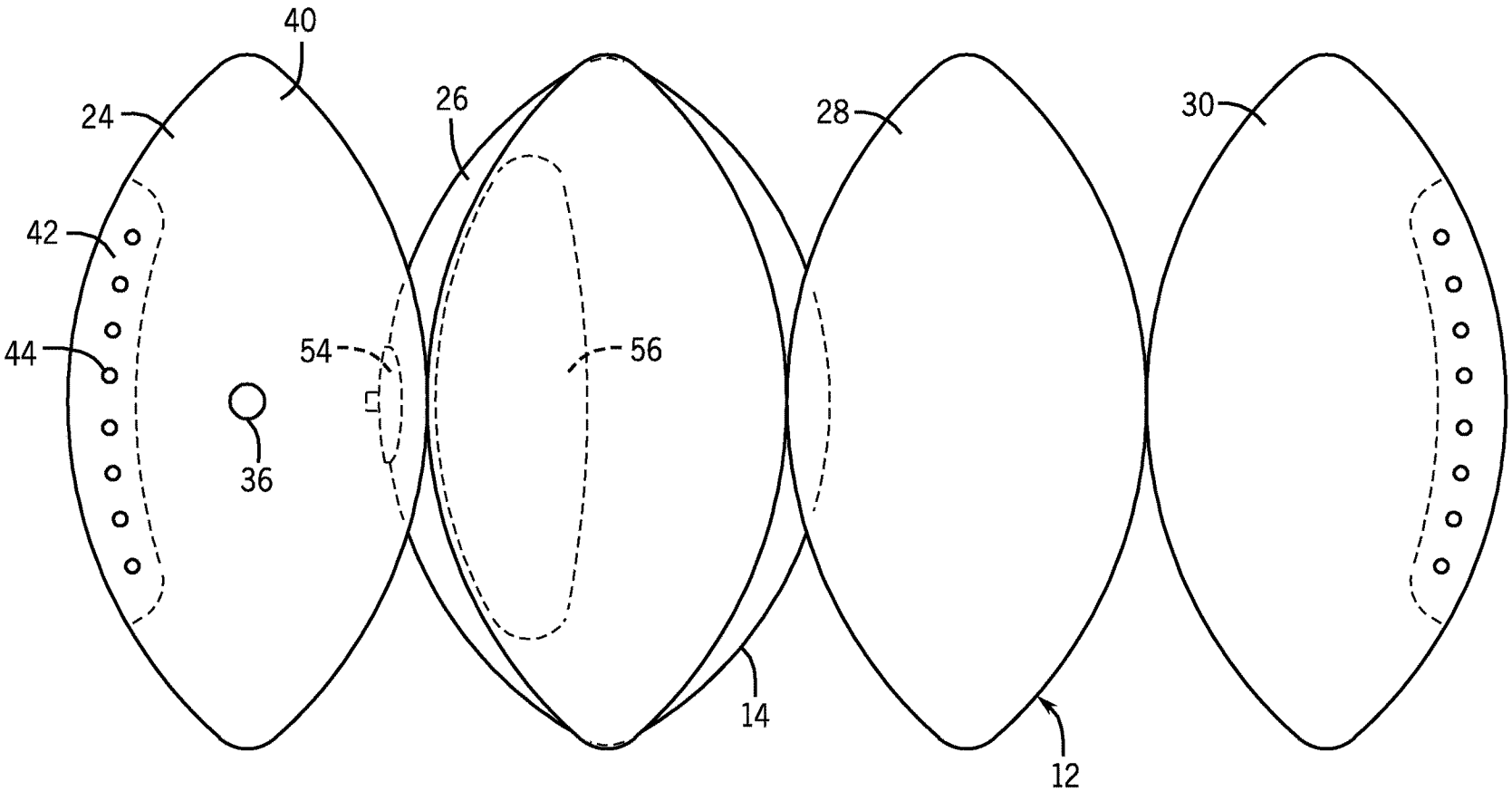
FIG. 2 is a top view of the football of FIG. 1 having four cover panels uncovered from a bladder of the football.
Figure 6:
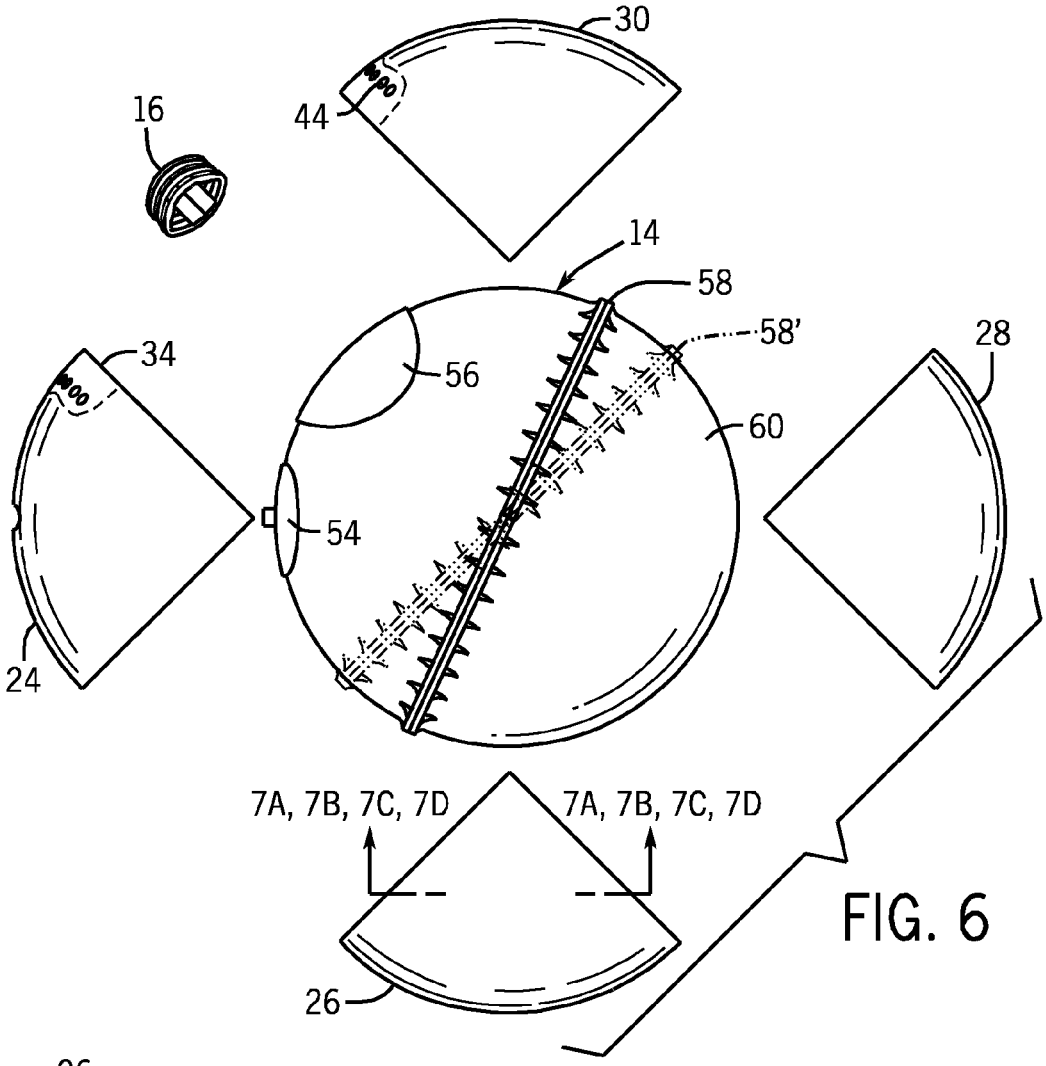
FIG. 6 is an exploded end view of the football of FIG. 1.

Referring to FIGS. 1, 2 and 6, the cover 12 is a prolate spheroidal shaped outer body preferably formed from first, second, third and fourth cover panels 24, 26, 28 and 30 that are joined to one another along generally longitudinally extending seams 32. The panels 24-30 are preferably stitched to each other. In alternative embodiments, the panels can be bonded, fused, stapled or otherwise fastened together with or without stitching. The longitudinal seam 32 connecting the first and fourth cover panels 24 and 30 includes a longitudinally extending slot 34. The slot 34 provides an opening for inserting the bladder 14 and, if applicable, other layers of material that may be applied over the bladder. The first cover panel 24 includes a valve aperture 36. The cover 12 provides the football 10 with a durable and grippable outer surface. An outer surface of the cover 12 preferably includes a pebbled texture for enhancing the grip and improving the aesthetics of the football 10. In alternative preferred embodiments, the cover 12 can be formed of a single piece or of two, three, five or other numbers of cover panels.

Figure 7A:
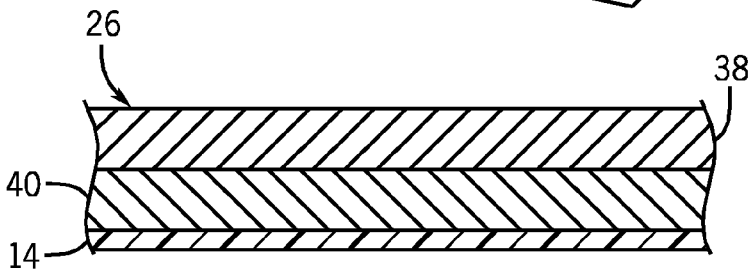
FIG. 7A is a cross-sectional view of a portion of the cover of the football taken about line 7A-7A of FIG. 6.

Referring to FIGS. 6 and 7A, one preferred embodiment of the construction of the cover panel 26 is shown. The cover panel 26 along with cover panels 24, 28 and 30 substantially enclose and protect the bladder 14. In a preferred embodiment, the cover panel 26 includes an outermost layer 38 that is formed of a durable, highly grippable material, such as, for example, a natural leather. Alternatively, the outermost layer 38 can be formed of other materials, such as, polyurethane, a synthetic leather, rubber, pigskin, other synthetic polymeric materials and/or combinations thereof. A lining 40 is applied via an adhesive to the inner surface of the outermost layer 38. Alternatively, the lining 40 can be bonded, cured, stitched sewn, press-fit, and/or fastened to the outermost layer 38. In still other embodiments, the lining can be a separate layer unattached to the outermost layer. The lining 40 is a layer of tough, durable material that increases the strength and durability of the football 10. The lining 40 is preferably formed of one or more layers of woven fabric and one or more layers of polyvinylchloride that are cured together to form an impregnated fabric layer. Alternatively, the lining can be formed of unwoven fabric, layers of fibers, rubber, a latex, ethyl vinyl acetate (eva), other polymeric elastomeric materials and/or combinations thereof. The lining 40 enables the football 10 to retain its desired shape and firmness. Referring to FIG. 2, the cover panels 24 and 30 preferably also include a reinforcing panel 42 at the laced region of the football 10 for providing further strength and structural integrity to the laced region of the football 10. The reinforcing panel 42 is preferably formed of the same material as the lining 40. Alternatively, other lining materials can also be used. Lace holes 44 are formed in the cover panels 24 and 30 at the reinforcing panels 42.

Figure 7B:
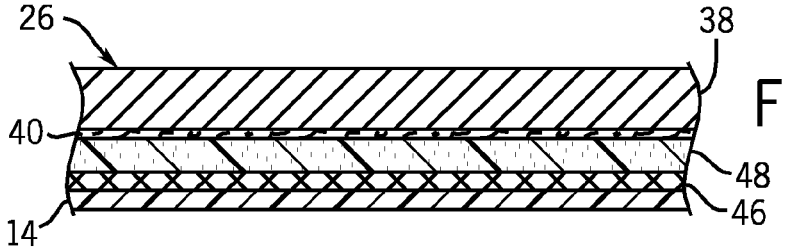
FIG. 7B is a cross-sectional view of a portion of the cover of the football taken about line 7B-7B of FIG. 6 in accordance with an alternative preferred embodiment of the present invention.
Figure 7C:
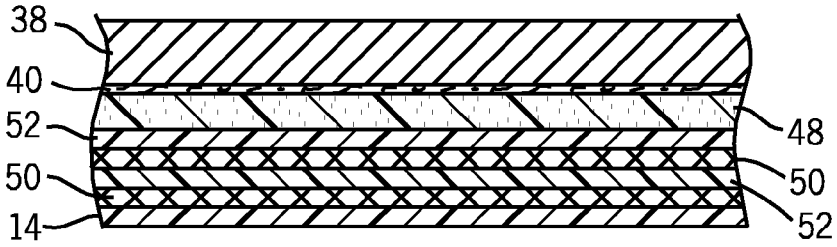
FIG. 7C is a cross-sectional view of a portion of the cover of the football taken about line 7C-7C of FIG. 6 in accordance with an alternative preferred embodiment of the present invention.
Figure 7D:
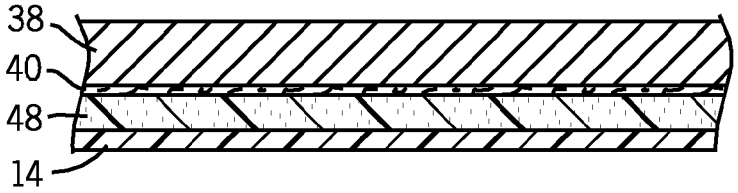
FIG. 7D is a cross-sectional view of a portion of the cover of the football taken about line 7D-7D of FIG. 6 in accordance with an alternative preferred embodiment of the present invention.

In alternative preferred embodiments, the cover 12 can have alternate constructions and one or more of layers of different materials can be formed over the bladder 14 beneath the cover 12. Referring to FIGS. 7B through 7D, alternative constructions of the cover 12 and additional layers of the football 10 are shown. In FIG. 7B, the cover 12 is a multilayered structure including a layer of windings 46 applied over the bladder 14 and a layer of padding 48 such as a sponge rubber layer formed over the layer of windings 46. Alternatively, other types or layers of padding materials can be used such as foams, sponges, and/or fibrous materials. The lining 40 can be formed of varying thicknesses or removed entirely. In FIG. 7C, fabric layers 50 are sandwiched with layers of rubber 52 to form a lining layer positioned over the bladder 14. A layer of padding 48 can be positioned over the layers 50 and 52 and beneath the outermost layer 38 and optionally a liner 40. In FIG. 7D, yet another construction is shown with a layer of padding 48 applied over the bladder 14 with lining 40 and the outermost layer 38 positioned over the layer of padding 48. Accordingly, the present invention contemplates the construction of the football 10 surrounding the bladder 14 taking the form of any combination of an outermost layer, a lining, one or more layers of padding, a winding layer, one or more fabric layers and one or more layers of elastomeric material.

Referring to FIGS. 1 and 2, the lacing 16 is used to further connect the cover panels 24 and 30 and to close the slot 34. The lacing 16 extends through the lace holes 44 of the cover panels 24 and 30. The lacing 16 also provides raised surfaces for a player to contact when passing, catching or holding onto the football 10.

Figure 3:
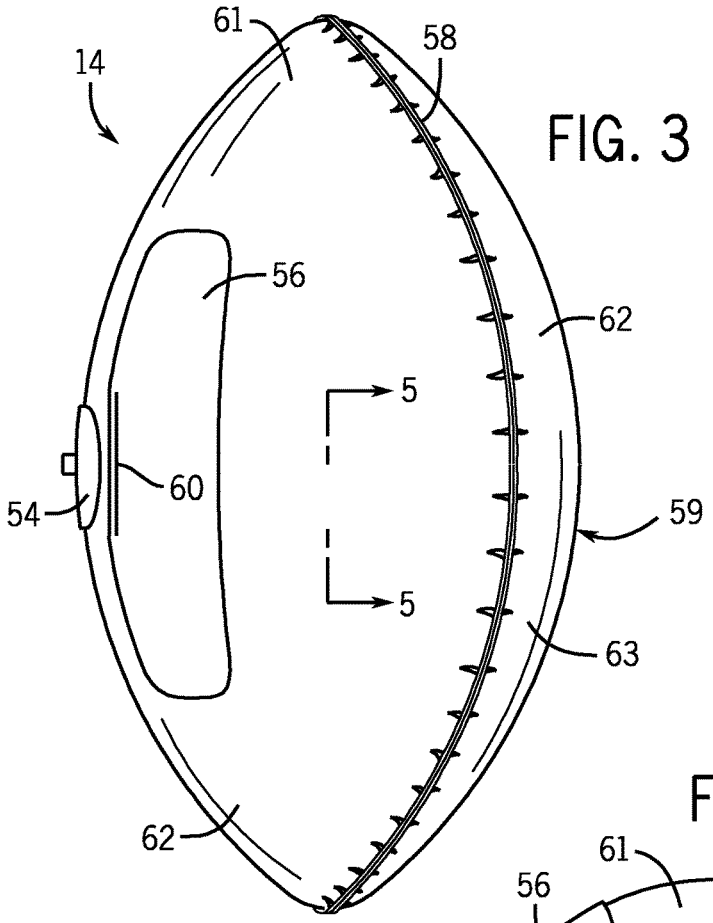
FIG. 3 is a side view of a bladder of the football of FIG. 1.
Figure 4:
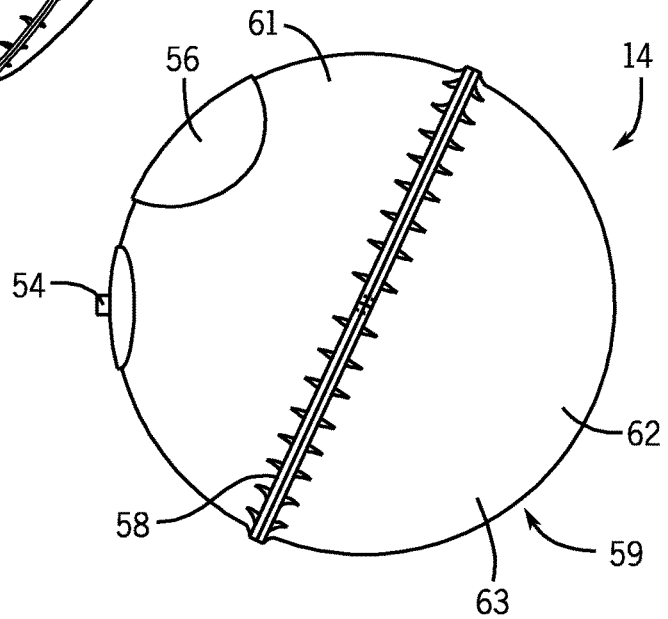
FIG. 4 is an end view of the bladder of FIG. 3.

Referring to FIGS. 2 through 4, the bladder 14 is an inflatable air tube preferably having a generally prolate spheroidal shape. The bladder 14 is inserted into the cover 12 through the slot 34. Alternatively, the cover 12, and other layers as applicable, can be formed over, positioned over or applied to the bladder. The bladder 14 receives and retains compressed air through a valve assembly 54 mounted to the bladder 14. The valve assembly 54 is configured to allow air to enter the bladder through use of an inflation needle (not shown) and, when removed, retain the air within the bladder 14. A portion of the valve assembly 54 is configured to extend into the valve aperture 36, which serves to orientate the bladder 14 with respect to the cover 12. In this manner, the position of the bladder 14 within the football 10 can be determined. The bladder 14 preferably includes a flap 56 positioned beneath the location of the lacing 16 for further protecting the bladder 14 from the lacing 16. The flap 56 is formed of a flexible material, preferably a vinyl. At least one edge 60 of the flap 56 is bonded to the bladder 14 through radio frequency (RF) welding. Alternatively, the flap can be formed of other materials, such as, for example, a urethane, a neoprene, a thermoplastic, a fabric, rubber, eva, leather, a foam layer, other polymeric material, or combinations thereof. In alternative preferred embodiments, the flap can be attached to the inner surface of the cover or another intermediate layer overlying the bladder. In another preferred embodiment, the football can be formed without the flap.

Referring to FIGS. 3 through 6, the bladder 14 is preferably formed of two multilayer sheets 62 of flexible, airtight material that are bonded to each other to form a bladder seam 58 through RF welding. The bladder seam 58 formed by the two sheets 62 defines an expandable cavity within the bladder 14. Alternatively, other means for forming an airtight bond between the two sheets 62 of material can also be used, including, for example, thermally bonded, chemical bonding, adhesive bonding, stitching, press-fitting, clamping and combinations thereof. The sheets 62 can also be referred to as walls, or side walls of the bladder, such as first and second side walls 61 and 63. The bladder seam 58 preferably extends generally longitudinally about the football 10. In alternative embodiments, the bladder seam 58 can be one or more seams extending longitudinally, laterally, in a helical manner or other path about the bladder 14. In another preferred embodiments, the bladder can be seamless and formed of a single or multi-layer sheet of material. The bladder 14 is preferably formed of a polyester urethane or an ether urethane, but can also be formed of other materials including other urethanes, other polymeric materials, rubber, vinyl, eva and combinations thereof.

Referring to FIG. 6, the location of the bladder seam 58 is also preferably positioned away, or angularly spaced, from the longitudinal seam 32 of the cover 12 with respect to a longitudinal axis 88 of the football 10 so that the seam 32 and the bladder seam 58 do not directly overlay each other. Alternatively, the bladder seam 58' can be rotated such that it is aligned with one or more of the seams 32.

Referring to FIG. 4, the sheets 62 of the bladder 14 are advantageously positioned such that the generally, longitudinally extending bladder seam 58 is positioned such that the bladder seam 58 does not interfere with a typical punt or kick-off of the football 10. The bladder seam 58 is preferably positioned such that it does not interfere with the side of the football opposite of the lacing 16. The flap 56 indicates the location of the lacing 16 over the bladder 14 on the assembled football. Therefore the side of the football 10 opposite the lacing is substantially free from the bladder seam 58. Since punters and kickers typically rotate the football 10 such that the laces are away from the location where the punter or kicker punts or kicks the football, the bladder seam 58 (and the bladder seam 58') is advantageously positioned so as not to extend over an area (kicking/punting region 59) of the football 10 that is likely to be impacted by the foot of the punter or kicker.

Figure 5A:
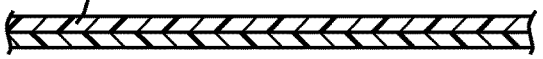
FIG. 5A is a cross-sectional view of the bladder taken about line 5-5 of FIG. 3.
Figure 5B:
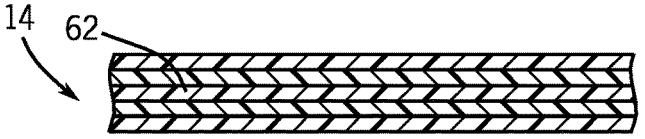
FIG. 5B is a cross-sectional view of the bladder taken about line 5-5 of FIG. 3 in accordance with an alternative preferred embodiment of the present invention.

Referring to FIGS. 5A and 5B, each multi-layer sheet 62 of the bladder 14 is formed of two or more layers of material. In FIG. 5A, the bladder 14 is formed of two layers and in FIG. 5B the bladder is formed of five layers. In other preferred embodiments, the sheet 62 of the bladder 14 can be a single layer or other multilayer combinations.

Referring to FIG. 1, an electronic chip 18 is shown in association with the football 10. FIGS. 1, and 8 through 30 illustrate preferred embodiments of the present invention in which the electronic chip 18 or circuit is optimally positioned on or within the football 10 to optimize the effectiveness of the electronics and to minimize or eliminate any negative impact the electronics may have on the play, feel and/or performance of the football 10. The positioning of the electronic chip 18 can also improve the feel, play and/or performance of the football 10. The electronic chip 18 is a circuit board including one or more electronic circuits and electronic devices. The electronic chip 18 is configured to actively transmit one or more electronic signals 66 used to indicate the location, movement, speed, acceleration, deceleration, rotation and/or temperature of the football. Alternatively, the electronic chip 18 can include a passive circuit that allows for the detection of the location, movement, speed, acceleration, deceleration, rotation and/or temperature of the football to be ascertained when subjected to a magnetic field or other sensing system. The electronic chip 18 has a weight of less than 1 ounce, and more preferably, a weight of less than 0.5 ounce.

FIGS. 8 through 23 illustrate the electronic chip 18 retained within a pocket 64 within or on the bladder 14. The present invention contemplates that alternative means for securing the electronic chip to or within the bladder can also be employed. In alternative preferred embodiments, the electronic chip 18 can be bonded, fused, clipped, retained, fastened through hook and loop fasteners, buckles or other fasteners to the bladder.

Figure 9:
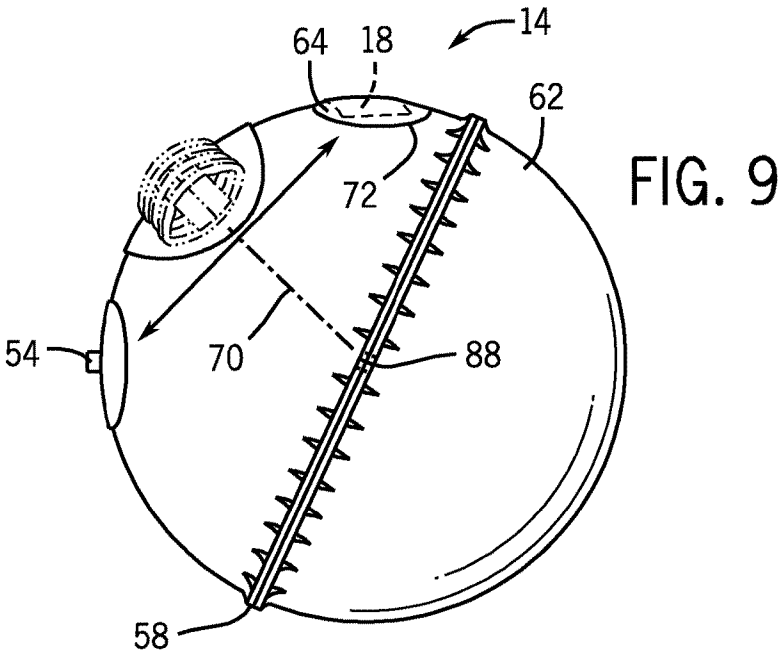
FIG. 9 is an end view of the bladder of the football of FIG. 8.
Figure 8:
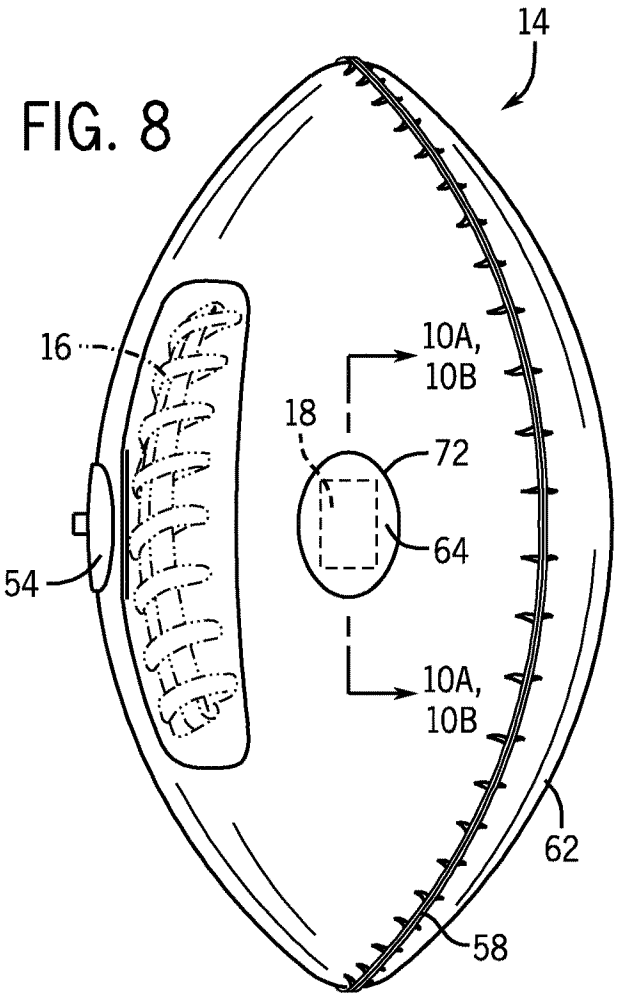
FIG. 8 is a side view of a bladder of a football in accordance with a preferred embodiment of the present invention.

Referring to FIGS. 8 and 9, one preferred embodiment of the present invention is illustrated. The lacing 16 is shown in silhouette over the flap 56 to indicate the position of the lacing 16 on the football 10. The electronic chip 18 is positioned in the pocket 64 formed by the multi-layer sheet 62 of the bladder 14 or applied to the bladder 14. The pocket 64 is preferably formed at a location that is symmetrical with the valve assembly 54. In particular, the pocket 64 and the valve assembly 54 are symmetrically positioned or substantially equidistant from a longitudinally extending first plane 70. The first plane 70 extends through the longitudinal center of the lacing 16 and the longitudinal axis 88 such that the pocket 64 and the electronic chip 18 are balanced about, or symmetrical about, the plane 70 with respect to the valve assembly 54. In one particularly preferred embodiment, the weight of the electronic chip 18 can be configured to be substantially the same as the weight of the valve assembly 54. The position of the electronic chip 18 is also advantageously positioned away from the kicking or punting side of the football 10 (kicking/punting region 59). Therefore, the electronic chip 18 is less likely to receive or be affected by the blunt impact of a kick or punt during play. Further, by positioning the electronic chip 18 on or within the bladder 14, the electronic chip 18 is protected by the cover panel 30 from the outside environment, including moisture, rain, snow and mud. Additionally, through placement of the electronic chip 18 in the pocket 64 on the sheet 62 of the bladder 15, the electronic chip 18 can be maintained in a relatively fixed position or location with respect to the cover 12 of the ball. Given the air pressure of the bladder 14, the durability and strength of the cover 12 and the location of the electronic chip 18 on the bladder 14, the electronic chip 18 can be maintained in a generally predetermined position during play, with minimal movement apart from the cover 12 or the lacing 16 of the football 10.

Figure 10B:
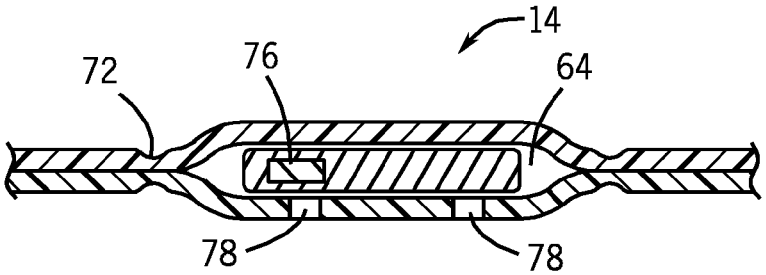
FIG. 10B is a cross-sectional view of a portion of the bladder taken about line 10B-10B of FIG. 8 and in accordance with an alternative preferred embodiment of the present invention.
Figure 10C:
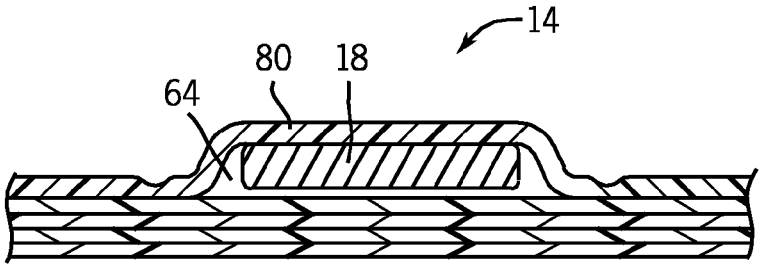
FIG. 10C is a cross-sectional view of a portion of the bladder in accordance with another alternative preferred embodiment of the present invention.
Figure 10A:
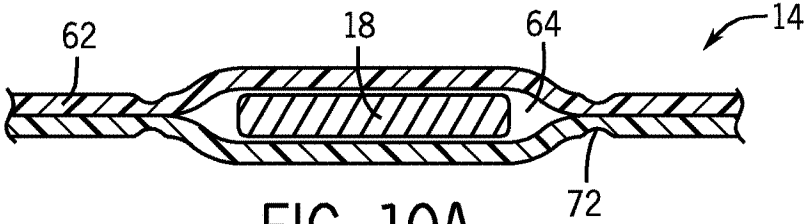
FIG. 10A is a cross-sectional view of a portion of the bladder taken about line 10A-10A of FIG. 8.

Referring to FIG. 10A, the electronic chip 18 is shown positioned between two layers of the multi-layer sheet 62 forming the bladder 14. The multi-layered sheet 62 is heat sealed, preferably through RF welding, around the perimeter of the electronic chip 18 to create a pocket seal 72 forming the pocket 64. The pocket 64 retains the electronic chip 18 in a fixed position or within a confined area. The sheet 62 can be formed to exactly follow the contour of the electronic chip such that little or no space exists in the pocket 64 around the chip 18 and thereby retaining the electronic chip 18 in a substantially fixed position. Alternatively, the electronic chip 18 can be bonded, attached or fastened directly to the bladder 14 with or without a pocket surrounding the electronic chip 18.

Referring to FIG. 10B, an alternative preferred embodiment of the pocket 64 of the bladder 14 is shown. The electronic chip 18 can include a pneumatic sensor or a pressure sensor 76 for sensing air pressure changes within the bladder 14. The sensor 76 can be used to monitor air pressure within the bladder 14 and serve to activate the electronic circuit when a pressure fluctuation is sensed. In this manner, the sensor 76 can be used as part of the control logic of the electronic chip 18 to maximize available battery life of the electronic sensor and/or circuit. The electronic chip 18 can include shutdown logic that places the electronics of the electronic chip 18 into a standby or sleep mode until the football 10 is put into play. When the football 10 is moved, passed, kicked or punted, the air pressure within the football 10 can fluctuate or change. This change in air pressure is sensed by the sensor 76, which then activates the electronic chip 18 and places it in an operating mode. In order to allow for the electronic chip 18 and the sensor 76 to sense changes of air pressure within the bladder 14, one or more pocket openings 78 are formed in the inner layer or layers of the multilayered sheet 62 of the bladder 14. The pocket openings 78 enable the sensor 76 to sense air pressure fluctuations within the bladder 14 while enabling the bladder 14 to maintain its structural integrity and retain air within the bladder 14. In an alternative preferred embodiment, the sensor 76 can be a piezoelectric sensor or other form of motion sensor that enables the circuitry of the electronic chip 18 to activate when the football 10 is placed in motion, and enter a standby or sleep mode when the football 10 is at rest for a predetermined amount of time. The predetermined amount of time is preferably set at a value within the range of 5 minutes to 120 minutes.

The air pressure sensor 76 can also be used to indicate the air pressure within the bladder 14 and therefore the pressure of the football 10 itself. The signal produced through the sensor 76 and from the electronic chip 18 can be used to confirm that the air pressure is within a desired range or at a specific desired setting. For example, Official Wilson®, NFL® Footballs have a recommended air pressure range between 11-13 psi. It is generally known that kickers and punters prefer game footballs that are inflated to a higher pressure. The NFL® takes precautions to ensure that the game footballs used for kicking or punting are inflated within the allowable pressure range or recommended operating pressure range (typically 11-13 psi). However, in some organized football leagues, the game footballs may not be tightly controlled and a team, punter or kicker may have the ability to select from a group of game balls. If the game balls have the pressure sensor 76, one could use this information to select the game football that is the most pressurized (having the highest pressure). The electronic chip 18 can also include a temperature sensor for monitoring the temperature of the football 10. In cold temperatures, footballs used for kicking or punting are often kept in warmer locations (close to 70 F) to improve the responsiveness and performance of the football when kicked or punted. An electronic chip including a temperature sensor can be used to enable a team, kicker or punter to select the best football (most desirable temperature) for kicking or punting. Additionally, an organized league could implement a temperature range for the football relative to ambient game time temperature (e.g. plus or minus 20 degrees F. of ambient temperature).

Referring to FIG. 10C, the pocket 64 can be formed by adding an additional sheet 80 of material to the inner or outer surface of the bladder 14. The sheet 80 can be thermally sealed to the bladder 14, preferably through RF welding, to retain the electronic chip 18 on the inner or outer surface of the bladder 14. Alternatively, the additional sheet 80 can be attached to the bladder 14 through other fastening means.

Figure 11:
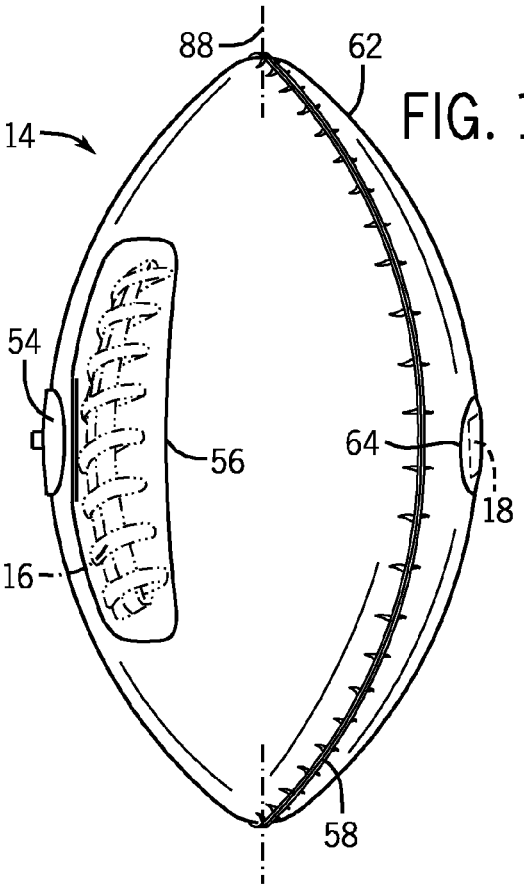
FIG. 11 is a side view of a bladder of a football in accordance with an alternative preferred embodiment of the present invention.
Figure 12:
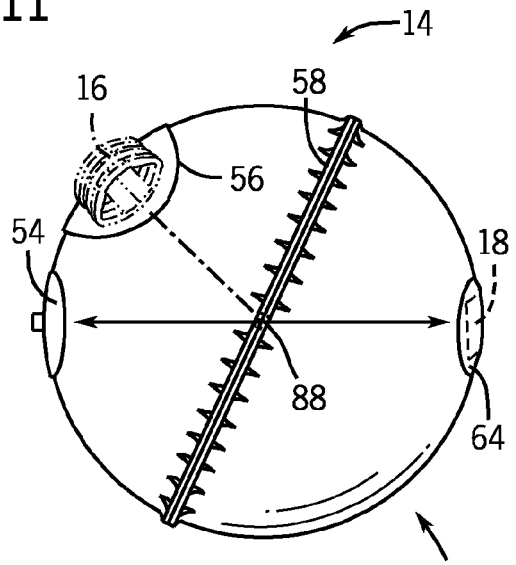
FIG. 12 is an end view of the bladder of the football of FIG. 11.

Referring to FIGS. 11 and 12, an alternative preferred embodiment of the present invention is illustrated. The position of the lacing 16 relative to the bladder 14 is shown in silhouette. The electronic chip 18 and the pocket 64 can be positioned at a location on or within the multi-layered sheet 62 of the bladder 14 that is opposite of the valve assembly 54 with respect to the longitudinal axis 88. In this configuration, a second plane that also intersects the longitudinal axis 88 can also intersect at least a portion of the valve assembly 54 and at least a portion of the electronic chip 18. In this location, the electronic chip 18 is balanced by the valve assembly 54. The electronic chip 18 can be configured to have a weight that is substantially the same as the valve assembly 54 thereby improving the balance of the football 10 about the longitudinal axis 88. The distance of the valve assembly 54 and the electronic chip 18 can be substantially equidistant from the axis 88. The location is also away from primary kicking and punting location (kicking/punting region 59) on the football 10 opposite the lacing 16.

Figure 13:
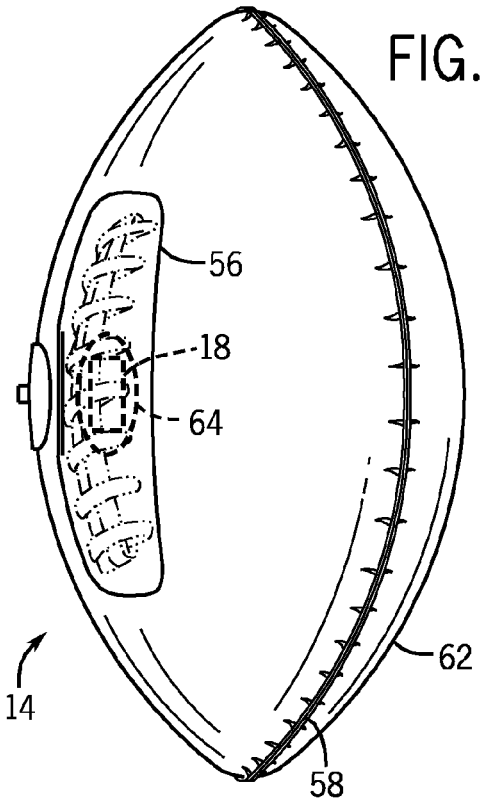
FIG. 13 is a side view of a bladder of a football in accordance with an alternative preferred embodiment of the present invention.
Figure 14:
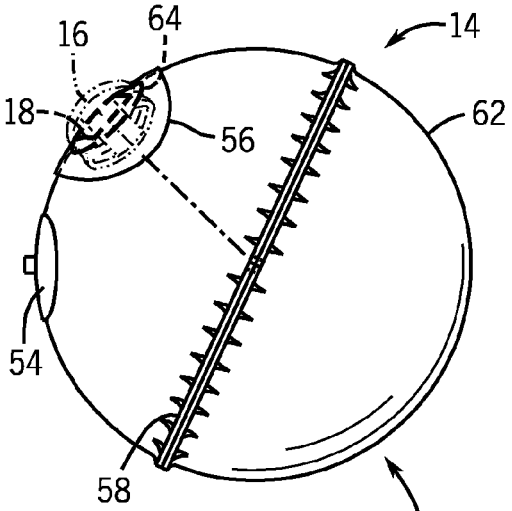
FIG. 14 is an end view of the bladder of the football of FIG. 13.

Referring to FIGS. 13 and 14, an alternative preferred embodiment of the present invention is illustrated. The position of the lacing 16 relative to the bladder 14 is shown in silhouette. The electronic chip 18 and the pocket 64 can be positioned at a location on or within the multi-layered sheet 62 of the bladder 14 that is underneath the lacing 16 and the flap 56. In this location, the electronic chip 18 is protected from impacts during play by the lacing 16, the cover 12 (FIG. 1), and the flap 56. Further, the location of the electronic chip 18 is directly opposite the kicking/punting region 59 on the football 10. The location on the bladder 14 beneath the lacing 16 on the football 10 is very advantageous because the electronic chip 18 is protected from a vast majority of the foreseeable impacts that occur to the football during play. Further, the location of the electronic chip 18 at the sheet 62 of the bladder 14 adjacent the cover and the lacing keeps electronic chip 18 in a generally fixed position during use. In one preferred embodiment, the electronic chip 18 is used to provide a small amount of additional weight near the laced region of the football 10 that can enhance the player's ability to impart rotation or spin to the football 10 as it is thrown or passed. In other preferred embodiments, weight is removed from the lacing or the cover to compensate for the small amount of additional weight added from the electronic chip 18. The Figures, including FIGS. 3, 4, 6, 8, 9 and 11 through 16, illustrate the flap 56 coupled to the outer surface of the bladder 14. The flap 56 extends over and defines an area about the outer surface of the bladder 14. As shown in at least FIGS. 13 and 14, the electronic chip 18 does not extend beyond the area defined by the flap 56.

Figure 15:
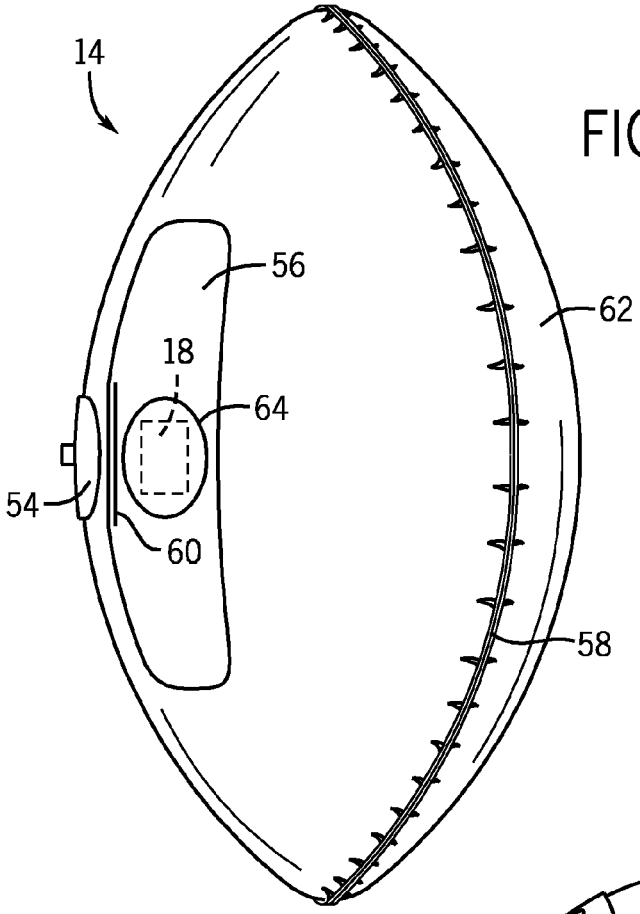
FIG. 15 is a side view of a bladder of a football in accordance with an alternative preferred embodiment of the present invention.
Figure 16:
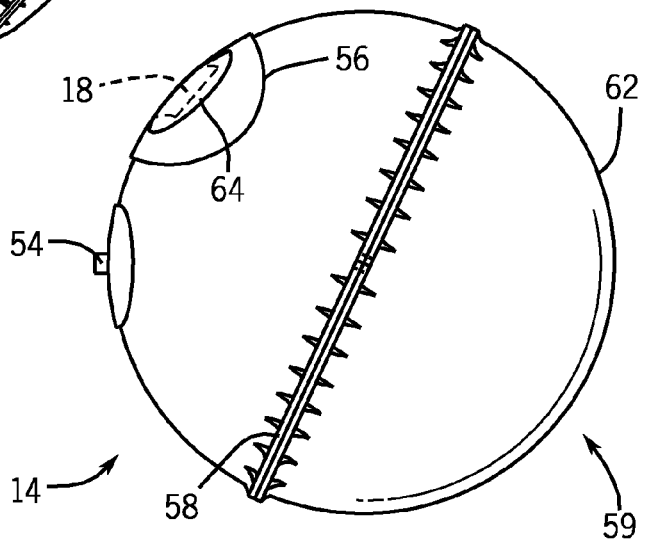
FIG. 16 is an end view of the bladder of the football of FIG. 15.

Referring to FIGS. 15 and 16, an alternative preferred embodiment of the present invention is illustrated. The electronic chip 18 and the pocket 64 can be positioned on the flap 56 at a location that is underneath the lacing 16. In this location, the electronic chip 18 is protected from impacts during play by the lacing 16, and the cover 12 (FIG. 1). Further, the location of the electronic chip 18 is directly opposite the kicking/punting region 59 on the football 10. In one preferred embodiment, the electronic chip 18 is used to provide a small amount of additional weight near the laced region of the football 10 that can enhance the player's ability to impart rotation or spin to the football 10 as it is thrown or passed. In other preferred embodiments, weight is removed from the lacing or the cover to compensate for the small amount of additional weight added from the electronic chip 18.

Referring to FIGS. 17, 18 and 19A, an alternative preferred embodiment of the present invention is illustrated. The electronic chip 18 and the pocket 64 can be positioned on a cross-member 82 longitudinally extending across the bladder 14. The cross-member 82 can be a planar, single or multi-layered sheet of material used to support the electronic chip 18 within the internal volume of bladder 14. In one particularly preferred embodiment, the cross-member 82 is a sheet that is bonded, preferably through RF welding, between first and second multi-layered sheets 62 of the bladder 14. The cross-member 82 thereby becomes part of the bladder seam 58, which provides generally uniform structural support to the cross-member 82. The cross-member 82 can be formed of a mixture of vinyl and polyester urethane. The mixture can be new material or a regrind of such materials. Alternatively, it can be formed of vinyl, other urethanes, fabric, a thermoplastic, other polymeric materials, rubber and combinations thereof. The cross-member 82 provides support to the electronic chip 18 in two dimensions across a plane. The uniform support provided by the bladder seam 58 enables the electronic chip 58 to be supported in the single plane. The material of the cross-member 82 and the tightness, tautness, or tension created during the formation of the bladder 14 can be varied to produce the desired operating position for the electronic chip 18. A stiffer, more rigid and/or higher tensioned material forming the cross-member 82 can be used to inhibit movement of the electronic chip 18 during play. In one preferred embodiment the cross-member 82 has a thickness of at least 0.004 inch, has an ultimate tensile strength of at least 3000 psi and has an ultimate elongation of at least 250 percent. In a particularly preferred embodiment, the cross-member has a thickness of at least 0.005 inch, an ultimate tensile strength of at least 7000 psi and an ultimate elongation of at least 400 percent.

The cross-member 82 preferably includes one or more openings 84 for allowing air within the bladder 14 to move freely from one side of the cross-member 84 to the other, and to readily equalize within the bladder during use. Without the openings 84, upon a sudden impact, such as a punt, a kick-off or a field goal attempt, a portion of the cover, typically opposite of the lacing, deflects inward thereby increasing the pressure of the air on kicked side of the football. Without the openings 84, the further pressurized air cannot communicate with the volume of air on the opposite side of the cross-member to equalize the pressure within the football. The pressure difference can have a negative effect on the flight and performance of the football, such as kicking distance, and the feel of the football. The openings 84 eliminate this issue by allowing for pressure to readily equalize throughout the internal volume of the bladder 14 following an impact.

Referring to FIG. 19A, the cross-member 82 supports the electronic chip 18 longitudinally and laterally about a plane defined by the cross-member 82. The cross-member 82 and the bladder seam 58 define the four symmetrically spaced openings 84.

The cross-member 82 can be formed of a very rigid and/or taut material inhibiting movement of the electronic chip 18 during movement of the football 10 and following impacts to the cover 12 of the football 10. Accordingly, when the bladder 14 within the football 10 is inflated to the recommended operating pressure range, the bladder 14 expands under the pressure. The expansion of the bladder 14 and the bladder seam 58 can render the cross-member taut and applies a tensile load to the cross-member 82 to keep the cross-member 82 in a taut position. The inflation of the bladder 14 to the recommended operating pressure can place a tensile load onto the cross-member 82. The tensile load is preferably at least 10 psi. In a particularly preferred embodiment, the tensile load is at least 50 psi. Additionally, the inflation of the bladder 14 to the recommended operating pressure can also cause the cross-member 82 to elongate in one or more direction depending upon the points of attachment of the cross-member 82 to the bladder side walls at the bladder seam 58. The elongation of the cross-member 82 is preferably within the range of 10 to 300 percent in at least one direction about the cross-member 82. In alternative embodiments, the cross-member 82 can be formed of a flexible material that more readily absorbs impacts during use.

Figure 19B:
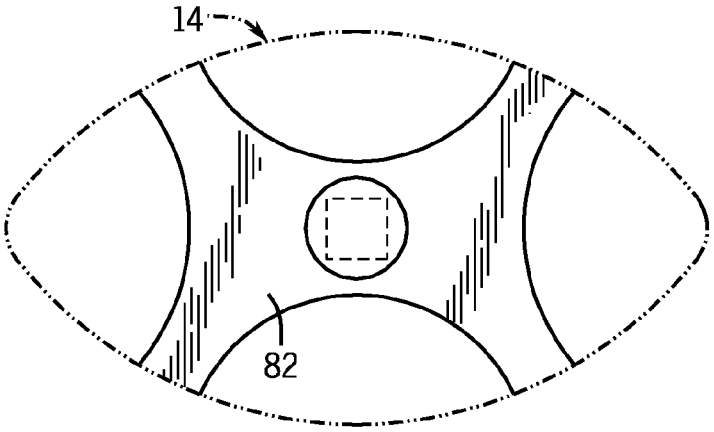
FIGS. 19B through 19E are cross-sectional views of a bladder of a football in accordance with other alternative preferred embodiments of the present invention.
Figure 19C:
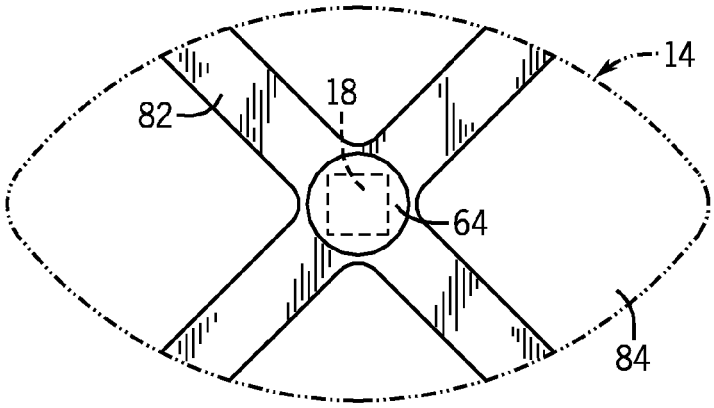

Referring to FIGS. 19B and 19C, two alternative preferred embodiments of the cross-member 82 within the bladder 14 are shown. In each embodiment, the openings 84 are defined by the cross-member 82 and the bladder seam 58. In each embodiment, the electronic chip 18 is supported bi-directionally about the plane defined by the cross-member 82 and the bladder seam 58.

Figure 19D:
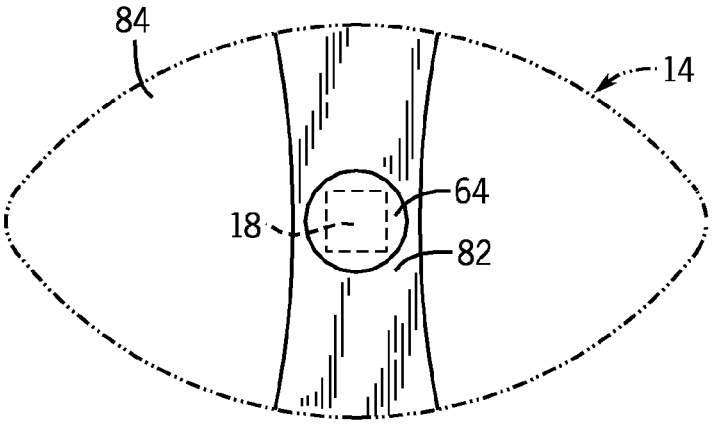
Figure 19E:
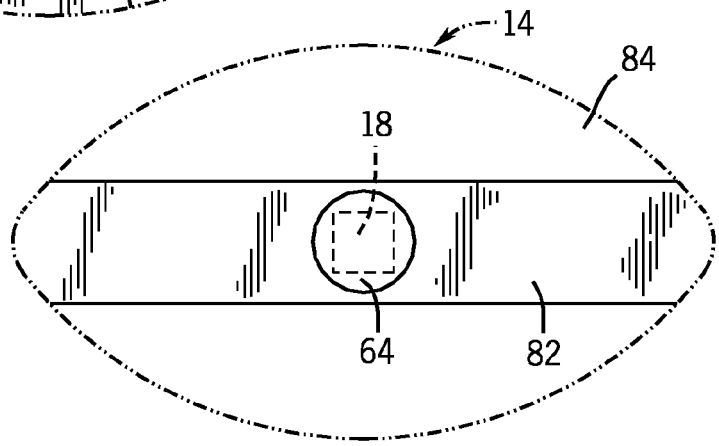

Referring to FIGS. 19D and 19E, two additional alternative preferred embodiments of the cross-member 82 within the bladder 14 are shown. In FIG. 19D, the cross-member 82 extends laterally or transversely across the internal volume of the bladder 14. In FIG. 19E, the cross-member 82 extends longitudinally across the internal volume of the bladder 14. In each embodiment, the cross-member 82 and the bladder seam 58 define two large openings 84. In other alternative preferred embodiments, the cross-member 82 can be formed of a plurality of threads, cords, wires, strings, springs, straps, bands, sheets or combinations thereof that support the electronic chip 18 within the bladder 14.

Figure 20A:
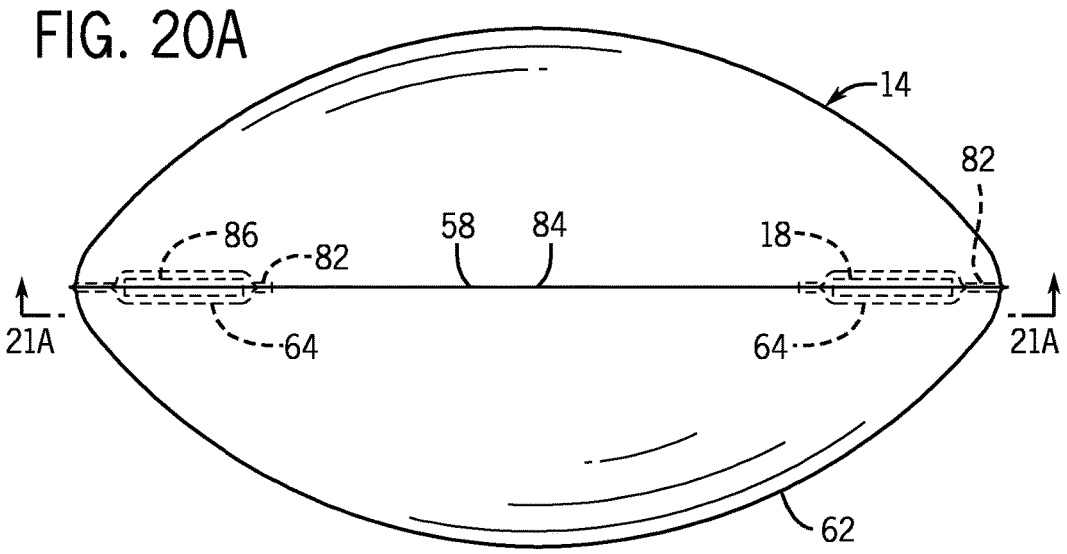
FIG. 20A is a side view of a bladder of a football in accordance with another alternative preferred embodiment of the present invention.
Figure 20B:
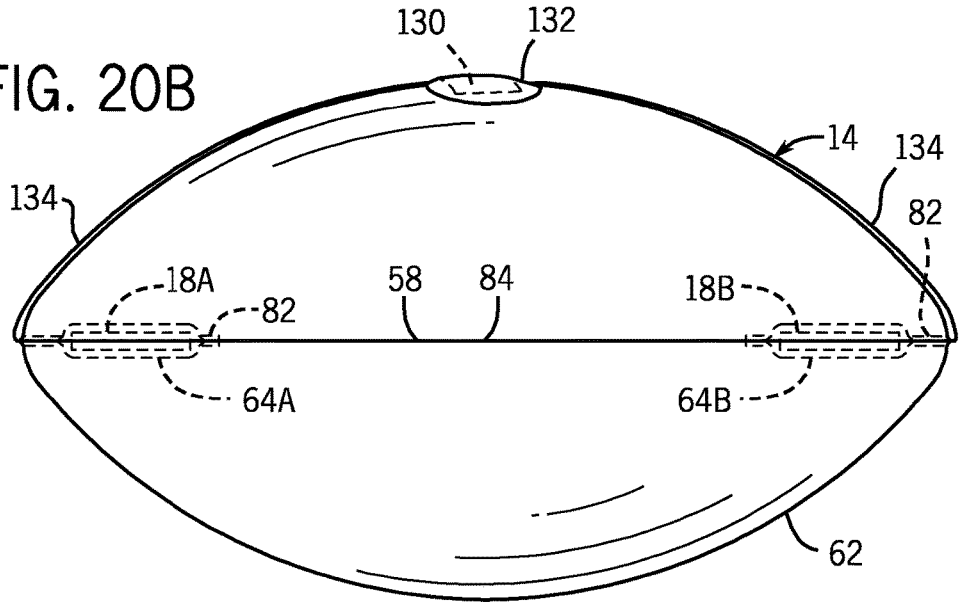
FIG. 20B is a side view of a bladder of a football in accordance with another alternative preferred embodiment of the present invention.
Figure 21A:
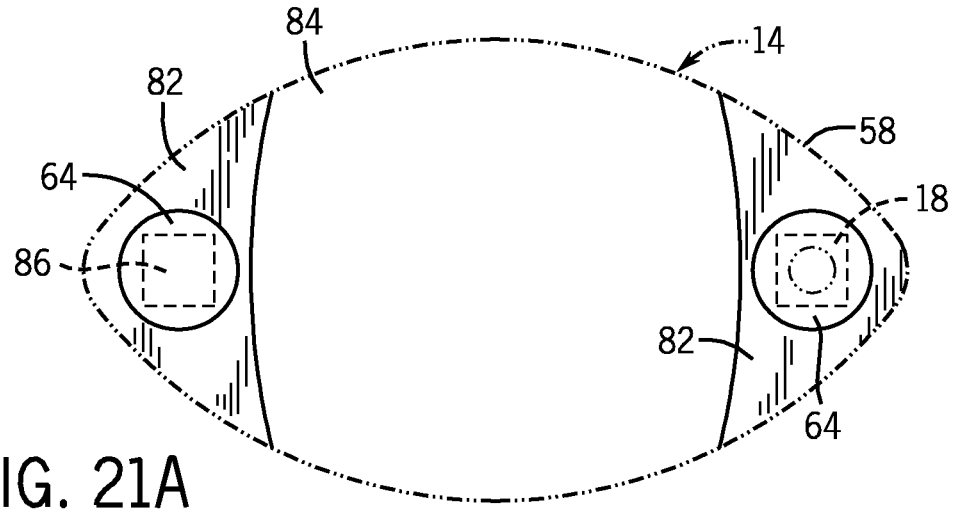
FIG. 21A is a cross-sectional view of the bladder taken about line 21A-21A of FIG. 20.

Referring to FIGS. 20 and 21A, another alternative preferred embodiment of the present invention is shown. The bladder 14 can be formed with one or more cross-members 82 extending across the bladder 14 along a plane defined by the cross-member 82. Each of the cross-members 82 is positioned between the sheets 62 of the bladder 14 and is secured to the bladder 14 at the bladder seam 58. In FIGS. 20 and 21A, two cross-members 82 are formed and positioned at opposite ends of the bladder 14. Each cross-member 82 can include the pocket 64 for receiving an electronic chip 18 or a counterweight 86. Two separate electronic chips 18 can be used in this preferred embodiment, or a single electronic chip 18 can be positioned on one cross-member 82 and the counterweight 86 can be positioned at the opposite end of the bladder 14. In this embodiment, the electronic chip 18 is suspended within the bladder 14 by one of the cross-members 82 at a position that is close to one end of the bladder 14. The distance between the electronic chip 18 and the bladder seam 58 is very small reducing the ability of the cross-member 82 and the electronic chip 18 to deflect during use. Further, the end of the football 10 is inherently more rigid and stable than the central regions of the football 10. The ends of the football 10 deflect significantly less than the central regions of the football 10 upon impact. Therefore, the electronic chip 18 is less likely to be affected by impacts to the cover of the football 10. The counterweight 86 can be positioned in a second cross-member 82, located at the opposite end of the bladder 14, to counterbalance the electronic chip 18. The counterweight 86 can have substantially the same weight as the electronic chip 18. Although FIGS. 20 and 21A illustrate a separate cross-member 82, one at each end of the bladder 14 with an electronic chip and a counterweight positioned in the pockets of the separate cross-members, in an alternative preferred embodiment, a single cross-member 82 positioned at one end of the bladder and having a pocket 64 with the electronic chip within it can be used. In this embodiment, neither an electronic chip nor a counterweight is positioned at the opposite end of the bladder.

Figure 21B:
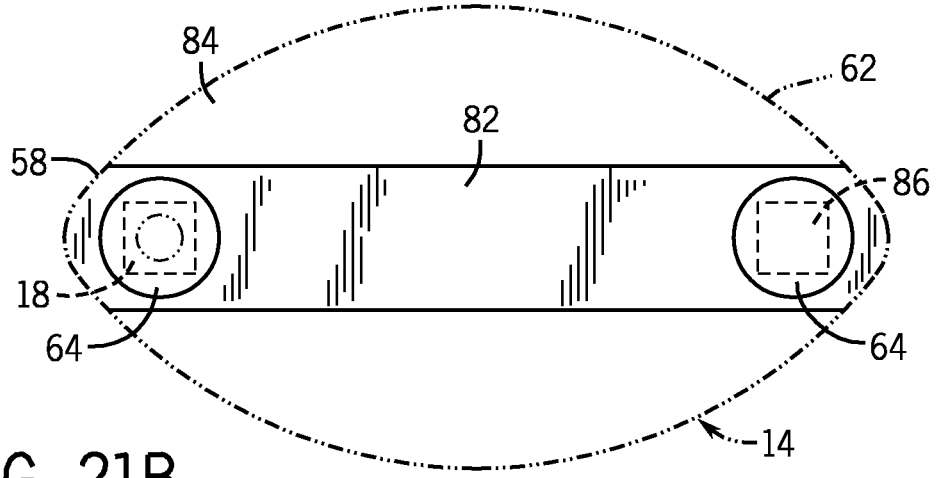
FIG. 21B is a cross-sectional view of a bladder of a football in accordance with another alternative preferred embodiment of the present invention.

Referring to FIG. 21B, in another alternative preferred embodiment, a single cross-member 82 can be used to support both the electronic chip 18 and/or the counterweight 86 (or a second electronic chip). Preferably, the electronic chip 18 and the counterweight 86 are positioned at or near opposite ends of the internal volume of the bladder 14. In this embodiment, the single cross-member 82 includes two pockets 64 (one at each end of the bladder 14). One pocket 64 retains the electronic chip and the second pocket 64 contains either the counterweight 86 or a second electronic chip. The single cross-member 82 is shown extending longitudinally about the bladder 14 in a plane defined by the cross-member 82. The cross-member 82 is secured to the sheets 62 of the bladder 14 at the bladder seam 58.

Referring to FIG. 20B, in another alternative preferred embodiment, the bladder 14 can be formed with one or more cross-members 82 extending across the bladder 14 along a plane defined by the cross-member 82 and by the bladder seam 58. Each of the cross-members 82 is positioned between the sheets 62 of the bladder 14 and is secured to the bladder 14 at the bladder seam 58. The cross-member 82 can include the first and second pockets 64A and 64B for receiving first and second electronic chips 18A and 18B. The first and second electronic chips 18A and 18B can be positioned at the opposite ends of the bladder 14. In this embodiment, the electronic chips 18A and 18B are suspended within the bladder 14 by the cross-member(s) 82 at a position that is close to the respective ends of the bladder 14. The distance between each of the electronic chips 18A and 18B and the bladder seam 58 is very small reducing the ability of the cross-member 82 and the electronic chip 18 to deflect during use, and enabling the electronic chips 18A and 18B to be maintained in a generally stable position within the bladder 14. The ends of the football 10 are inherently more rigid and stable than the central regions of the football 10 and deflect significantly less than the central regions of the football 10 upon impact. Therefore, the electronic chips 18A and 18B are less likely to be affected by impacts to the cover of the football 10.

In this embodiment, the first and second chips 18A and 18B can be used together to accurately transmit and/or indicate the correct position, speed, rotation, acceleration, deceleration and movement of football 10. The two electronic chips 18A and 18B can be used to improve the accuracy and reliability of the monitoring system. Alternatively, the first and second chips 18A and 18B can be essentially the same with one chip providing redundancy, or serving as a backup, to the other in event of a chip failure. In this embodiment, a battery 130 can be secured to the bladder 14 preferably in a battery pocket 132. Alternatively, the battery 130 can be coupled to the bladder 14 through other means, such as for example, bonding or hook and loop fastening. The location of the battery pocket 132 and the battery 130 is at the multi-layered sheet 62 of the bladder 14, preferably at a location that will be beneath the lacing on a completely assembled football 10. Wires 134 or leads can be used to operably connect the battery 130 to the first and second chips 18A and 18B. The battery 130 provides a source of power to the first and second chips 18A and 18B.

Figure 22:
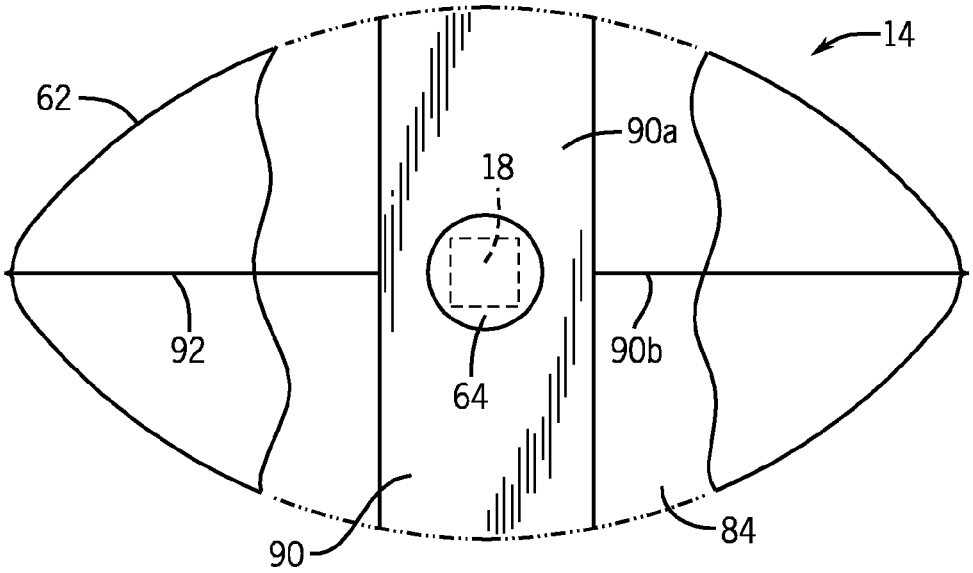
FIG. 22 is a side view of a bladder of a football in accordance with another alternative preferred embodiment of the present invention with a portion of the bladder removed to show the internal structure of the bladder.
Figure 23:
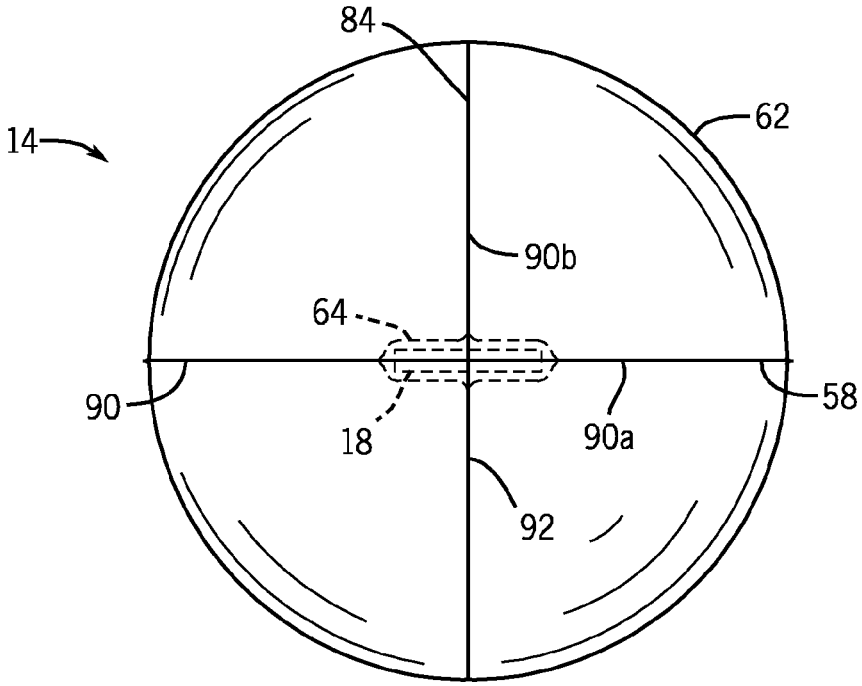
FIG. 23 is an end view of the bladder of the football of FIG. 22.

Referring to FIGS. 22 and 23, another alternative preferred embodiment of the present invention is illustrated. In preceding embodiments, the cross-member 82 extends about a single plane providing two-dimensional support to the electronic chip 18. In other alternative embodiments, the three-dimensional cross-member 90 can be used. The cross-member 90 can include two or more planar sections that connect to multiple locations about the sheets 62 of the bladder 14. In one particularly preferred embodiment, the cross-member 90 includes a first section 90*a* that extends laterally across the bladder 14 about a plane defined by the bladder seam 58 and in a manner similar to the cross-member 82 of FIG. 19D, and a second section 90*b* that extends orthogonally from the first section 90*a*. The first section 90*a* includes the pocket 64 that retains the electronic chip 18. In an alternative preferred embodiment, the pocket can reside on the second section 90*b*. The openings 84 are formed in both sections 90*a* and 90*b* of the cross-member 90 to allow for air to move freely and readily equalize within the bladder 14. The second section 90*b* is preferably secured to the bladder 14 by a second bladder seam 92 that secures the edges of the sheets 62 of the bladder 14. Accordingly, in the present preferred embodiment, the bladder 14 is formed of four separate multi-layered sheets 62 that are bonded together at first and second generally longitudinally extending bladder seams 58 and 92. The bladder seams 58 and 92 provide an effective, secure, reliable and durable means of attaching the cross-member 90 to the bladder 14. The three dimensional support of the electronic chip 18 provided by the cross-member 90 can substantially inhibit movement of the electronic chip during use. In alternative preferred embodiments, some edges of the cross-member can be secured to the bladder 14 through other means, such as for example, being bonded, fused, clipped, fastened via hoop and loop fasteners, buckles, or other fasteners. In such embodiments, the bladder can be formed without a bladder seam, with a single bladder seam, or two or more bladder seams. The three dimensional cross-member 90 can be arranged to form substantially 90 degree angles between the sections of the cross-member as illustrated. Alternatively, the sections of the cross member can extend at other angles from each other to provide three-dimensional support to the electronic chip positioned within the bladder 14. In another alternative preferred embodiment, the electronic chip 18 can be supported in a three-dimensional fashion through a plurality of threads, cords, wires, fibers, fabric strips, laces or combinations thereof.

Figure 24:
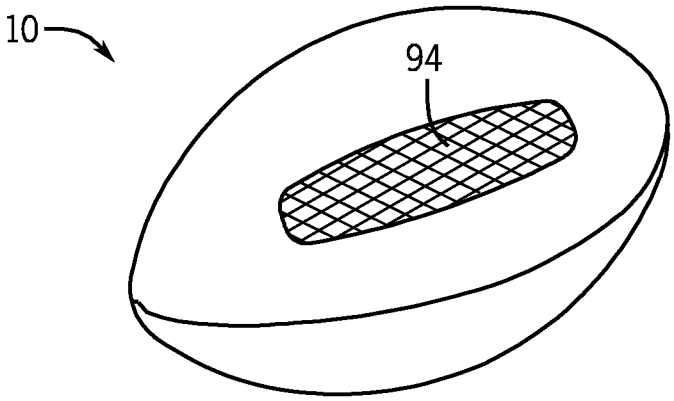
FIG. 24 is a side perspective view of an inner layer of a football in accordance with another alternative preferred embodiment of the present invention.
Figure 25:
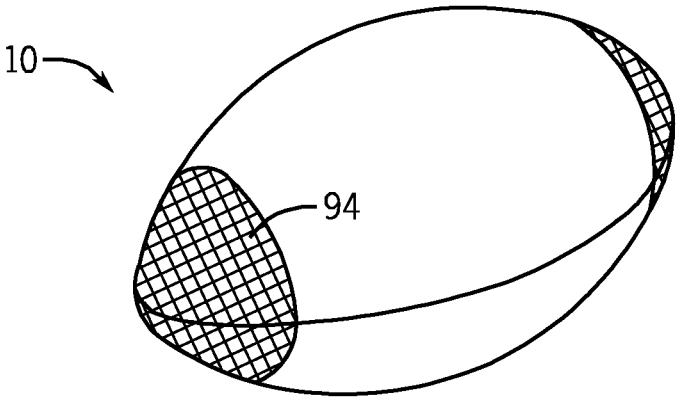
FIG. 25 is a side perspective view of an inner layer of a football in accordance with another alternative preferred embodiment of the present invention.
Figure 26:
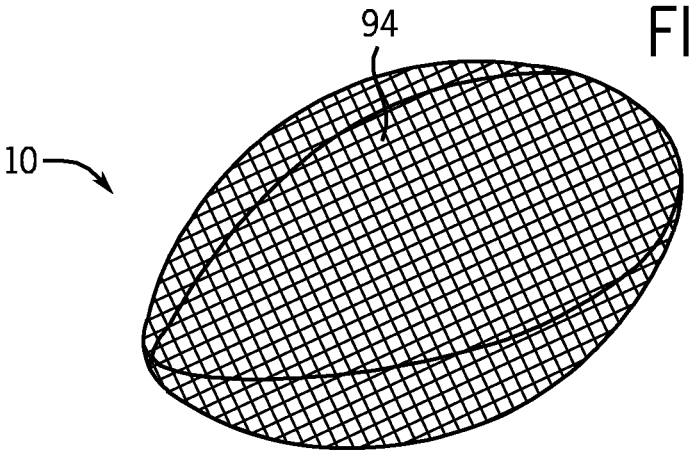
FIG. 26 is a side perspective view of an inner layer of a football in accordance with another alternative preferred embodiment of the present invention.
Figure 27A:
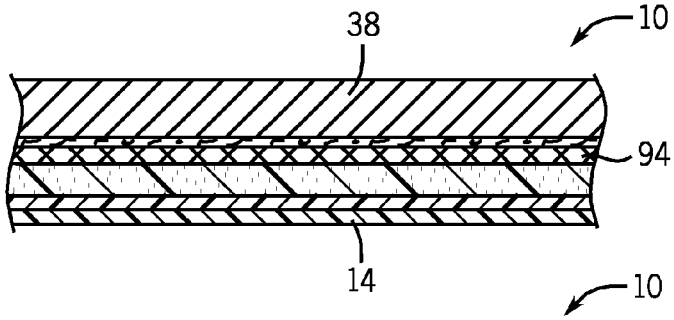
FIGS. 27A and 27B are cross-sectional views of a portion of a football in accordance with other alternative preferred embodiments of the present invention.
Figure 27B:
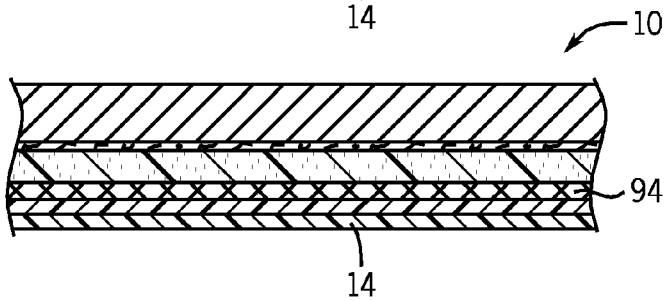

Referring to FIGS. 24 through 26, in alternative preferred embodiments of the present invention, the electronic chip is shown as a thin, flexible tag 94 that can be applied to the football, the bladder or an intermediate layer of the football as a patch (FIG. 24), a plurality of patches (FIG. 25), or an additional layer (FIG. 26). The tag 94 can be a radio frequency identification (RFID) tag or chip. The RFID tag is an integrated circuit for storing and processing information, and modulating and demodulating a radio-frequency (RF) signal. The RFID tag also includes at least one antenna for receiving and transmitting the signal. The tag can be passive or active, including a battery as a power source. In other alternative preferred embodiments, the tag 94 can be a wire mesh, or a pattern or a circuit configured to affect a magnetic field or create a voltage change at it moves through or about a sensing area. In other alternative preferred embodiments, the electronic chip is configured with one or more receivers, transmitters, transceivers, power sources, processors, micro-controllers and switches. Referring to FIGS. 24 through 27B, the tag 94 can be applied as a patch or a layer at any desired location about or within the football 10 including on the inner (FIG. 27A) or outer surface of the cover 12, within the cover 12, on (FIG. 27B) or within the bladder 14 or within other layers such as winding layers, linings, and padding layers.

Figure 28:
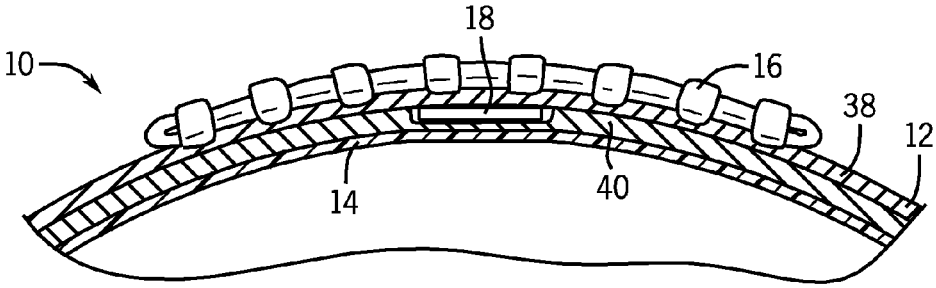
FIGS. 28-30 are cross-sectional views of a section of a football in accordance with other alternative preferred embodiments of the present invention.
Figure 29:
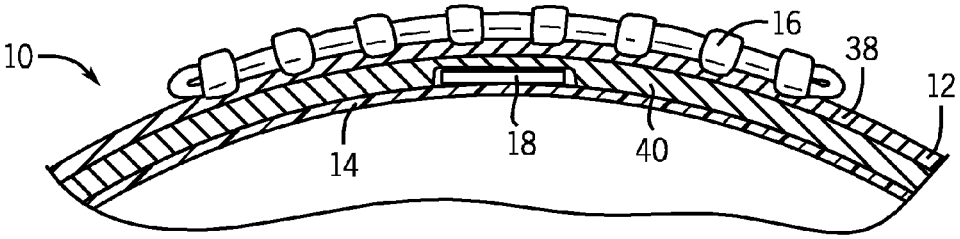
Figure 30:
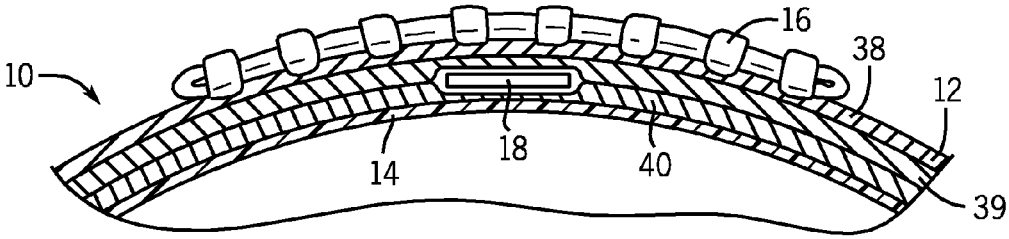

Referring to FIGS. 28 through 30, alternative preferred embodiments of the present invention are illustrated. The electronic chip 18 can be positioned outside of the bladder 14 in other locations within the football 10. In FIG. 28, the electronic chip 18 is positioned within the cover 12 beneath the outermost surface 38 in a recess formed in the lining 40 of the cover 12. The electronic chip 18 can also be advantageously positioned beneath the lacing 16 for additional protection and positioning away from the kicking region of the football 10. Referring to FIG. 29, the electronic chip 18 can also be positioned on the inner surface of the lining 40 adjacent to the bladder 14. In another preferred embodiment, one or more intermediate layers 39 can be positioned between the liner 40 and the bladder 14. The electronic chip 18 can be positioned within the intermediate layer 39 or between the lining and the intermediate layer as shown in FIG. 30. If additional intermediate layers are employed in the football construction, the electronic chip can positioned over, under or within such intermediate layers.

Figure 31:
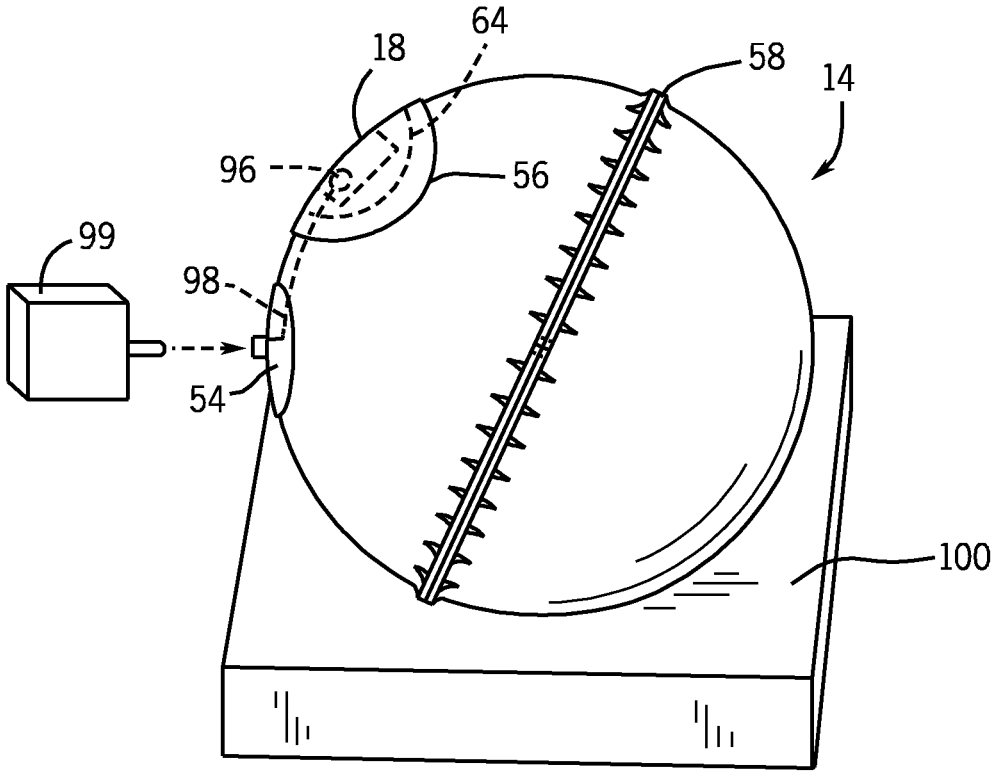
FIG. 31 is an end view of a bladder of a football in accordance with another alternative preferred embodiment of the present invention.

Referring to FIG. 31, the electronic chip 18 can be an active chip including a power source, such as a battery 96. In one preferred embodiment, the battery 96 can be a rechargeable battery. Leads 98 for charging the battery 96 can extend from the battery 96 toward the outer surface of the football 10 for engagement with a charging device. In one particularly preferred embodiment, the leads 98 can extend from the battery 96 into the valve assembly 54, which is adapted to receive a charging device 99 for operably engaging the leads 98. The charging device 99 provides a power source to the leads 98 for transfer to the battery 96. The charging device 99 can be self contained and wireless or wired to an electrical grid. In another alternative preferred embodiment, the football can be formed with a second opening and structure that resembles a valve assembly. An adapter coupled to the battery can be inserted into the second opening. The adapter can be configured for operably engaging a charging device. In another alternative preferred embodiment, the battery 96 can be charged wirelessly through a wireless charger 100 positioned near the football 10 during charging. The wireless charger 100 generates an electromagnetic field to recharge laptop batteries wirelessly. In another alternative preferred embodiment, the battery 96 can be positioned at or near the outer surface of the football to allow for its replacement. For example, the battery 96 can be positioned underneath the lacing, which can be configured to be repositioned to allow access to the battery for removal and replacement. In another example, the battery can be positioned within or accessible through the valve assembly.

Figure 32:
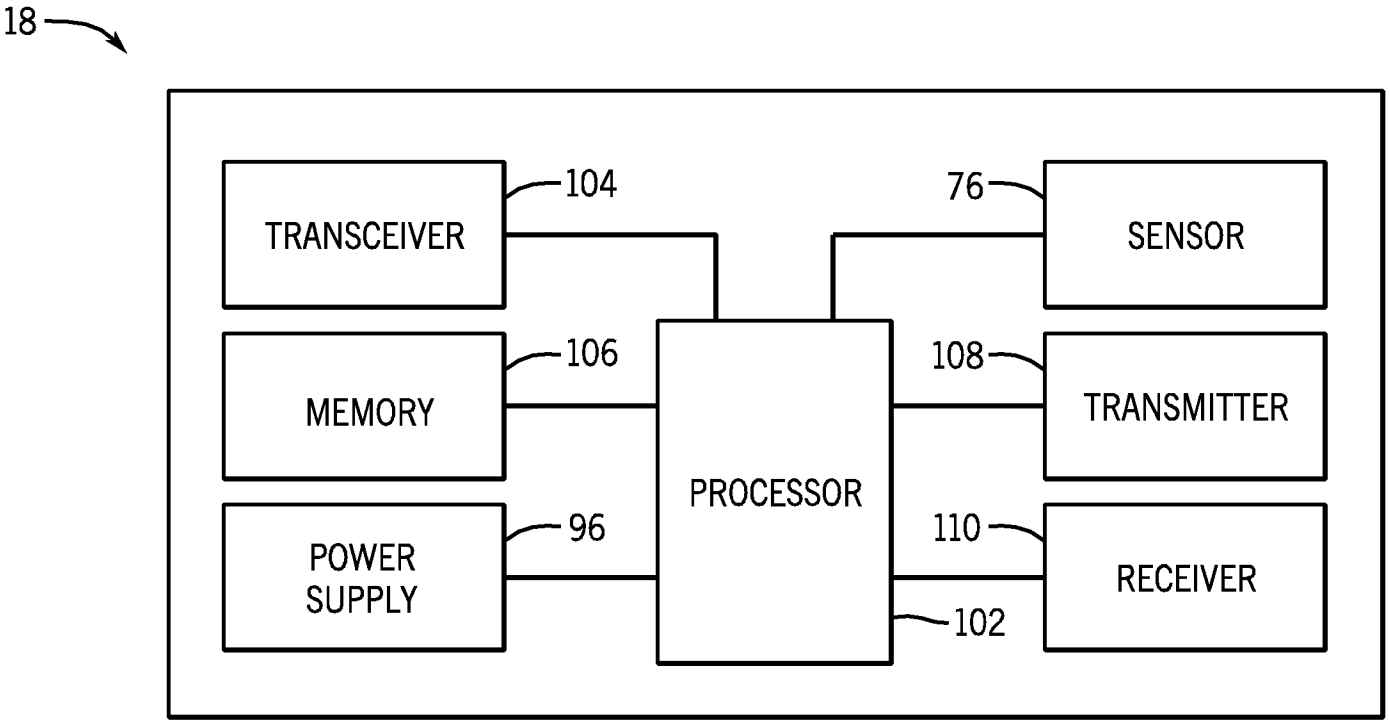
FIG. 32 is a diagram of an example of an electronic chip used on a football in accordance with a preferred embodiment of the present invention.

Referring to FIG. 32, the electronic chip 18 is shown in more detail. The electronic chip 18 includes a plurality of electronic devices such as, for example, sensors, receivers, transmitters, transceivers, power supplies, memory, micro-processors, micro-controllers, analog to digital converters, and combinations thereof. The electronic chip 18 can be arranged with a wide range of combinations of one or more of these components. In one particular embodiment (FIG. 32), the electronic chip 18 includes a circuit board having a processor 102, a transceiver 104, memory 106, the sensor 76, a transmitter 108, a receiver 110 and the power supply (the battery 96). The processor 102 is preferably a micro-processor or a micro-controller capable of processing algorithms, routines, programs and/or applications. The processor 102 can include a timer or sample rate capability. The memory 106 is operably associated with the processor 102 and is used to store data, instructions, programs, and files. The memory 106 can include read only memory and random access memory.

The transceiver 104 is a combination of a receiver and a transmitter that is operably coupled to the processor 102. The transceiver can be coupled to an antenna. The transceiver 104 can send or receive a signal, such as the electronic signal 66, and to exchange information and data with a remote outside sensor, a receiver, a server, a computer, a network of computers or the Internet. The transmitter 108 and the receiver 110 can also be used to send and receive, respectively, a signal representing information and data for communication with a remote sensor, transmitter, receiver, server, computer, computer network or the Internet. The transmitter 108 and receiver 110 along with the battery 96 and the sensor 76 are also operably coupled to the processor 102.

Figure 33:
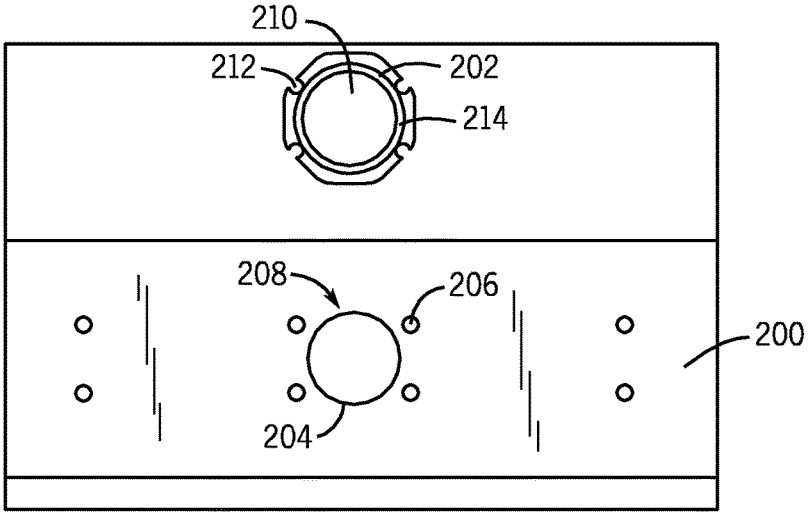
FIG. 33 is a top view of first and second pocket forming dies in accordance with a preferred method of the present invention.
Figure 35:
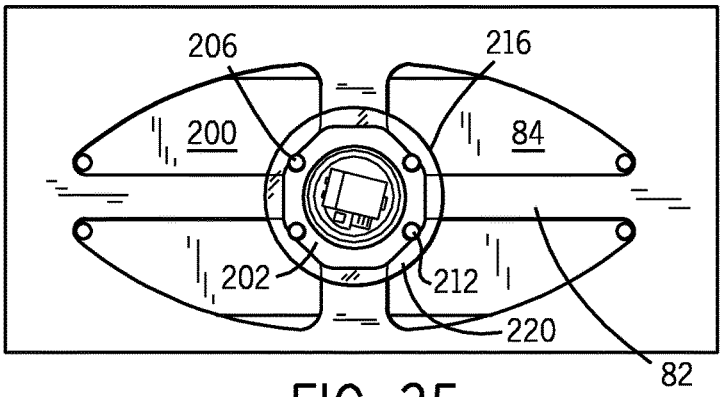
Figure 36:
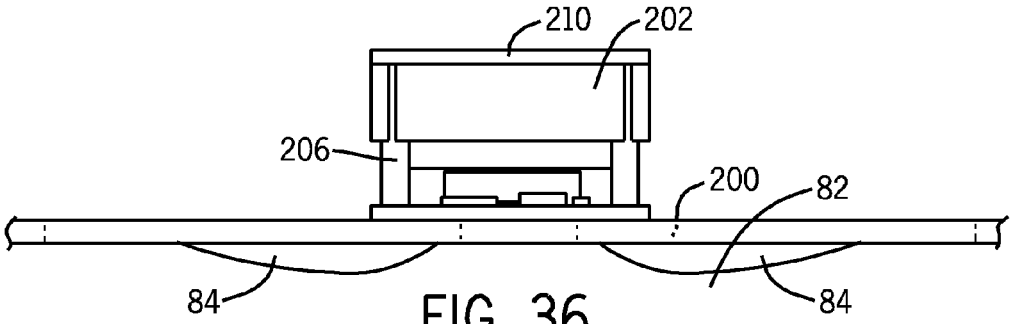
FIG. 36 is a side view of the first and second pocket forming dies and the cross-member of the bladder prior to formation of the pocket in accordance with a preferred method of the present invention.
Figure 37:
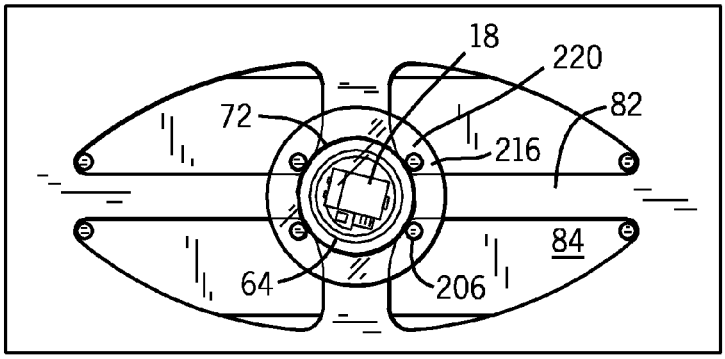
FIGS. 37 and 38 are top views of the cross-member of FIG. 34 following the formation of a pocket in accordance with a preferred method of the present invention.

Referring to FIGS. 33 through 38, a preferred method of forming the pocket 64 for retaining the electronic chip 18 within the bladder 14 is illustrated. The method produces the pocket 64 centrally positioned on the cross-over member 82 similar to the preferred embodiment of FIG. 19A. Referring to FIG. 33, first and second pocket dies 200 and 202 are shown. The first pocket die 200 includes an opening 204 for locating the electronic chip 18 during formation of the pocket 64. The first pocket die 200 also includes a plurality of dowel pins 206 and a press surface 208 for forming the pocket seal 72 or seam (FIG. 37). The second pocket die 202 includes a central opening 210 for locating the electronic chip 18, a plurality of guide holes 212 for receiving the dowel pins 206, and a press ring 214 for forming the pocket seal or seam 72.

Figure 34:
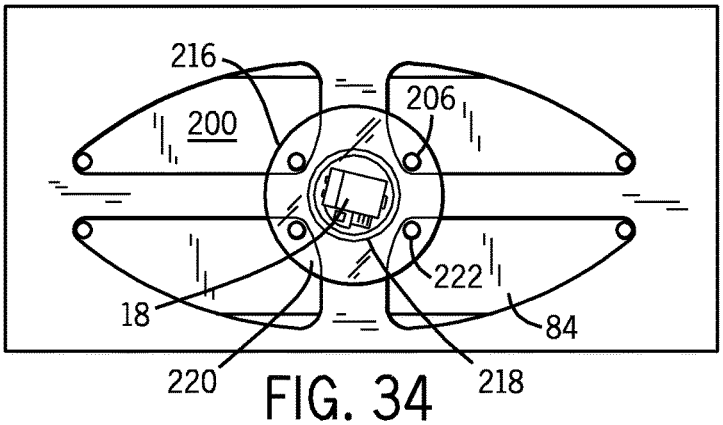
FIGS. 34 and 35 are top views of different stages of the method of forming a pocket for retaining an electronic chip on a cross-member of a bladder in accordance with a preferred method of the present invention.

Referring to FIG. 34, the dowel pins 206 are used to align a plurality of sheets of bladder and/or pocket material. In this preferred method of forming the pocket 64, a first pocket forming sheet 216 is placed onto the first pocket die 200. The first pocket forming sheet 216 includes alignment holes for receiving the dowel pins 206. The electronic chip 18 is placed onto the first sheet 216 at the location of the opening 204. The cross-member 82 is then placed over the first pocket die 200. The cross-member 82 includes a chip opening 218 and the openings 84 for allowing for equalization of air pressure within the completed bladder 14. The cross-member 82 is aligned with the dowel pins 206. A second pocket forming sheet 220 is then placed over the first sheet 218, the electronic chip 18 and a portion of the cross-member 82. The second pocket forming sheet 220 includes a set of alignment holes 222 for receiving the dowel pins 206.

Referring to FIGS. 35 and 36, the second pocket die 202 is then placed over the first and second sheets 216 and 220. The dowel pins 206 are aligned with the guide holes 212 of second pocket die 202 such that the press ring 214 contacts the second pocket forming sheet 220. The first and second dies 200 and 202 are then placed into a press and RF welding is used to formed at the location of the press ring 214 to form the pocket seal 72.

Figure 38:
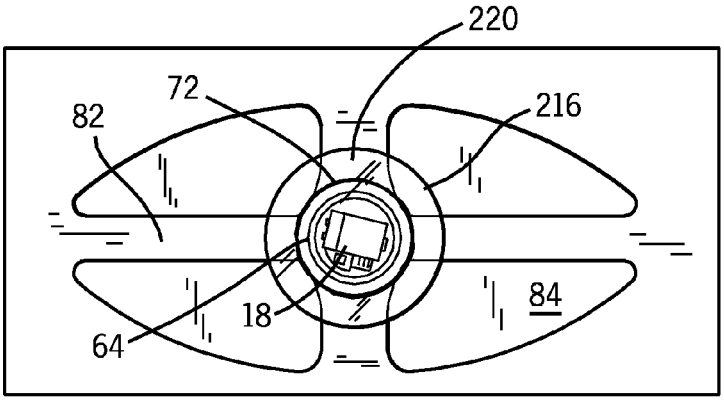

Referring to FIGS. 37 and 38, the cross-member 82 and the formed pocket 64 are shown after the RF welding of the pocket seal 72. The first and second sheets 216 and 220 are enclosed around the electronic chip 18 and a portion of the cross-member 82 at the pocket seal 72 to form the pocket 64. Referring to FIG. 38, the cross-member 82 including the pocket 64 and the electronic chip 18 is shown removed from the press. The first and second pocket forming sheets 216 and 220 are similar to the sheets 62 and the cross-member 82. Each of the first and second sheets 216 and 220 can single or multi-layered, and the first and second sheets 216 and 220 can be formed be formed of similar materials as the sheets 62 and the cross-member 82. The size, shape and number of the openings 84 in the cross-member 82 can be varied. The openings 84 must be sufficiently sized to enable air pressure within the finished bladder to readily equalize following an impact (such as a kick) during use.

The excess material of the first and second sheets 216 and 220 outside of the pocket 64 and the pocket seal 72 can be trimmed away and discarded or recycled. In one preferred method, a series of perforations can be formed in the sheets 216 and 220 just outside of the pocket seal 72 to facilitate the trimming or removal of the excess material of the sheets 216 and 220 from the assembled cross-member 82 having the pocket 64 and the electronic chip 18. Alternatively, the excess material of the first and second sheets 216 and 220 outside of the pocket seal 72 can be left in place on the cross-member 82.

Figure 39:
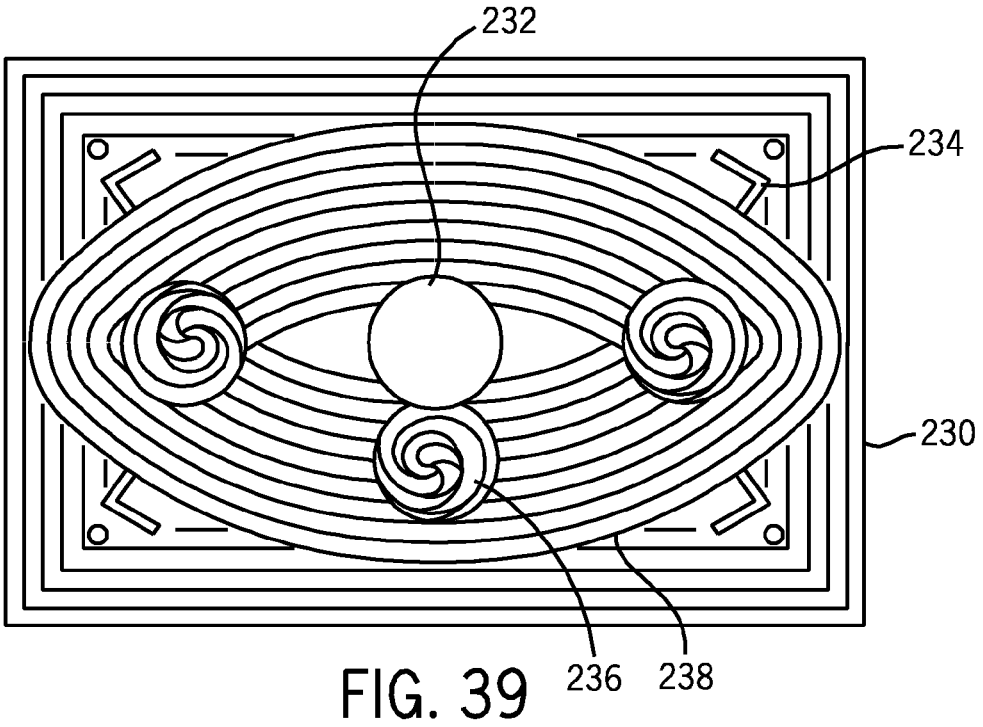
FIGS. 39 and 40 are top views of first and second bladder dies, respectfully for forming a bladder in accordance with a preferred method and embodiment of the present invention.
Figure 40:
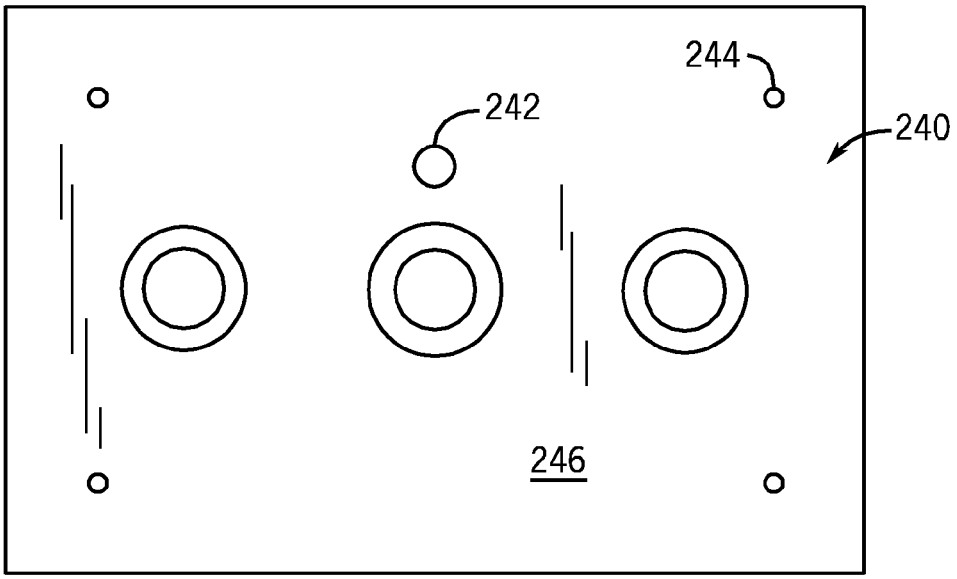

Referring to FIGS. 39 through 48, a preferred method of producing the bladder 14 in accordance with a preferred embodiment of the present invention is illustrated. Referring to FIG. 39, a first bladder die 230 is shown. A chip receiving opening 232, a plurality of alignment holes 234, and a first valve recess 236 for accommodating the valve assembly 54 are defined in the first bladder die 230. The first bladder die 230 includes a sealing ridge 238 for forming the bladder seam 58. Referring to FIG. 40, a second bladder die 240 includes second valve recess 242 and a plurality of dowel pins 244 for engaging the alignment holes 234 of the first die 230. The second bladder die 240 further includes a press surface 246 for forming the bladder seam 58 with the sealing ridge 238.

Figure 41:
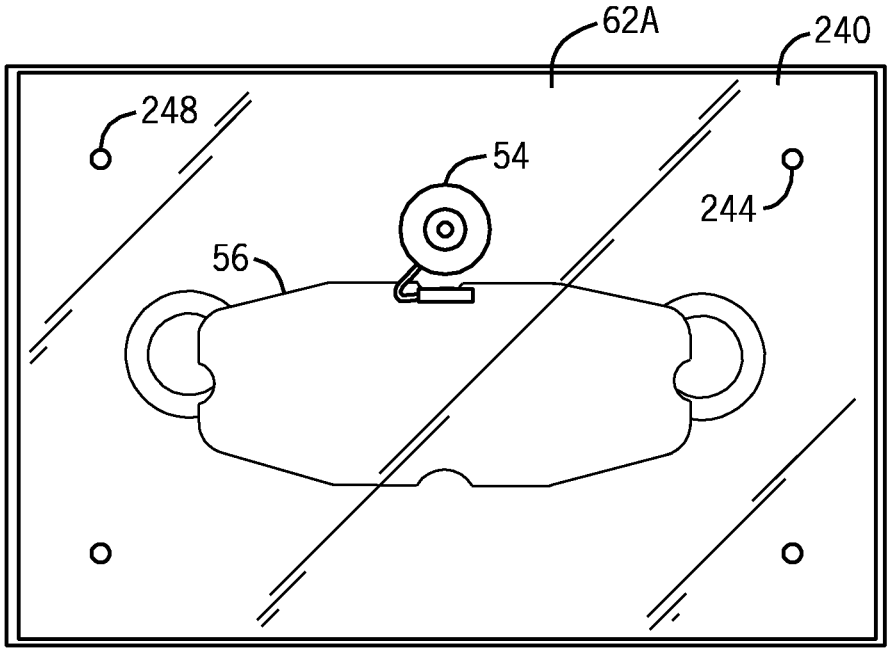
FIGS. 41 through 43 are top views of the laying up or the formation of a bladder in accordance with a preferred method of the present invention.
Figure 42:
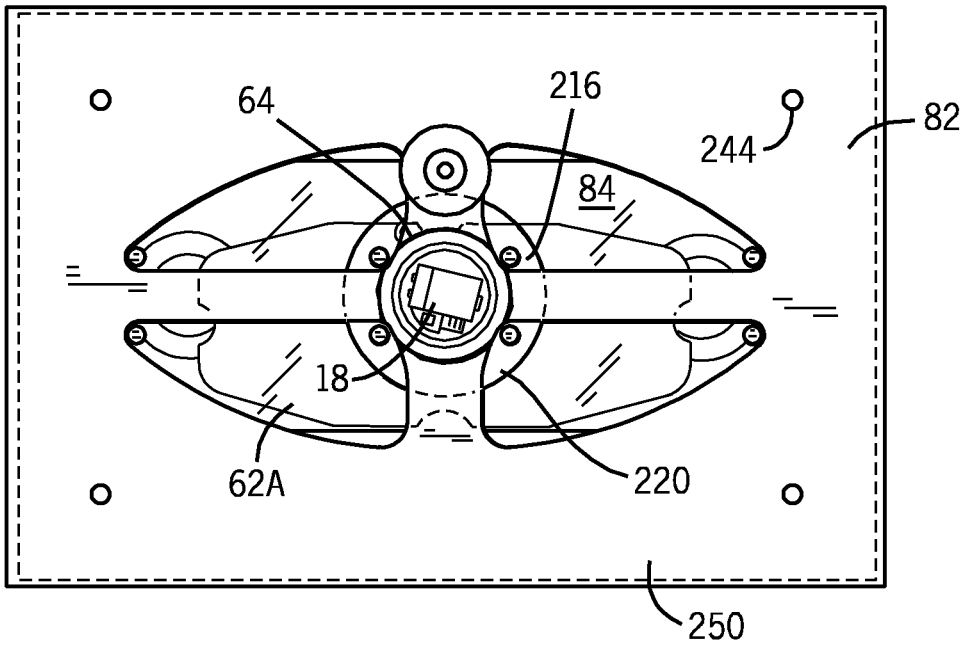
Figure 43:
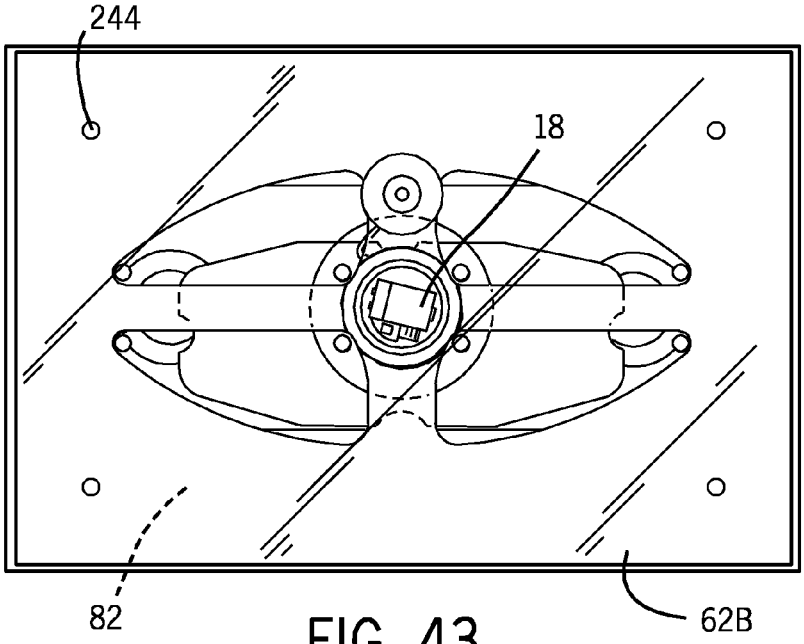

Referring to FIG. 41, a first single or multi-layered sheet 62A (substantially the same as the sheet 62) is placed onto the second bladder die 240. The first sheet 62A includes the valve assembly 54 and the flap 56. A set of alignment holes 248 are formed into the first sheet 62A for proper alignment and engagement with the dowel pins 244. Referring to FIG. 42, the assembled cross-member 82 of FIG. 38 is placed over the first sheet 62A. The cross-member 82 also includes a set of alignment holes 250 for receiving the dowel pins 244. Referring to FIG. 43, a second single or multi-layered sheet 62B (also substantially the same as the sheet 62) is placed over the cross-member 82. The second sheet 62B includes a set of alignment holes 252 for receiving the dowel pins 244.

Figure 44:
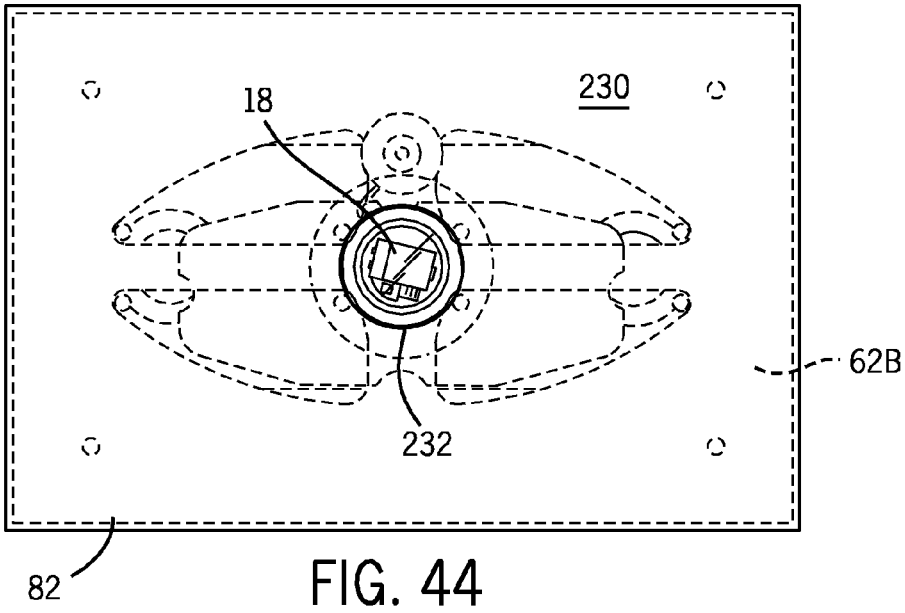
FIG. 44 is a top view of the second bladder die prior to the formation of the bladder in accordance with a preferred method of the present invention.
Figure 45:
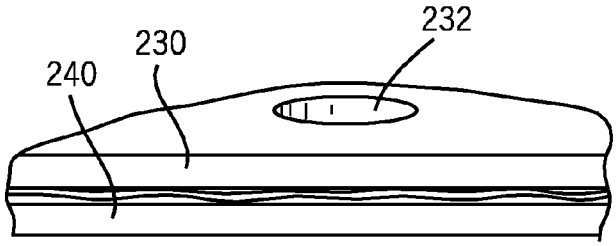
FIG. 45 is a side view of the first and second bladder dies prior to the formation of the bladder in accordance with a preferred method of the present invention.

Referring to FIGS. 44 and 45, the first bladder die 230 is shown placed over the first and second sheets 62A and 62B and the cross-member 82. The chip receiving opening 232 of the first bladder die 230 is aligned over the electronic chip 18. The first and second bladder dies 230 and 240 are then pressed together. RF welding applied at the engagement location of the sealing ridge 238 of the first die 230 and the press surface 246 of the second die 240 produces the bladder seam 58.

Figure 46:
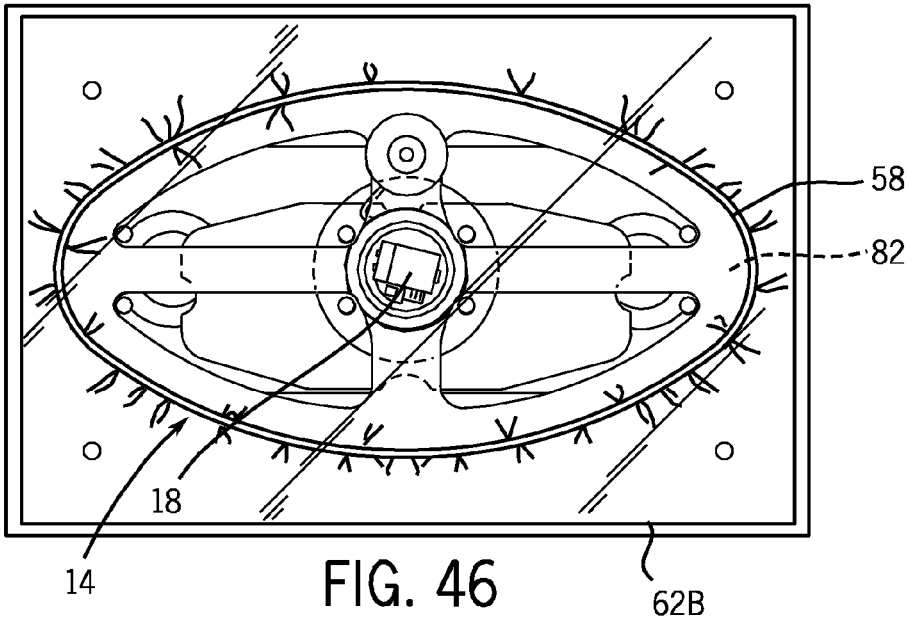
FIGS. 46 through 48 are top views of a completed bladder in accordance with a preferred method of the present invention.
Figure 47:
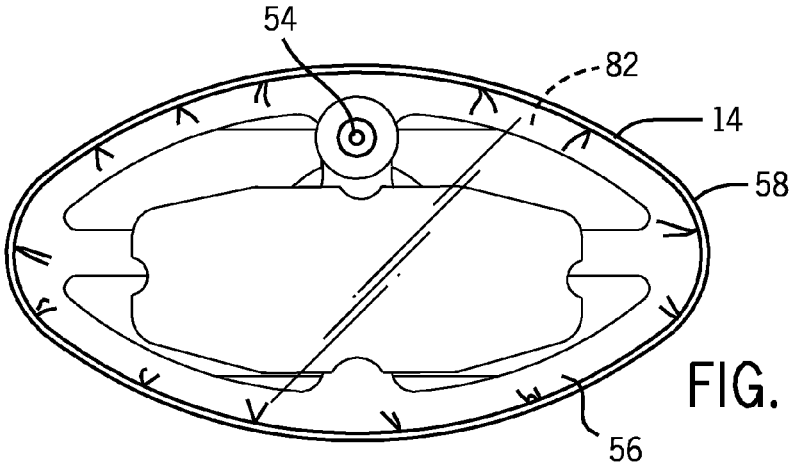
Figure 48:
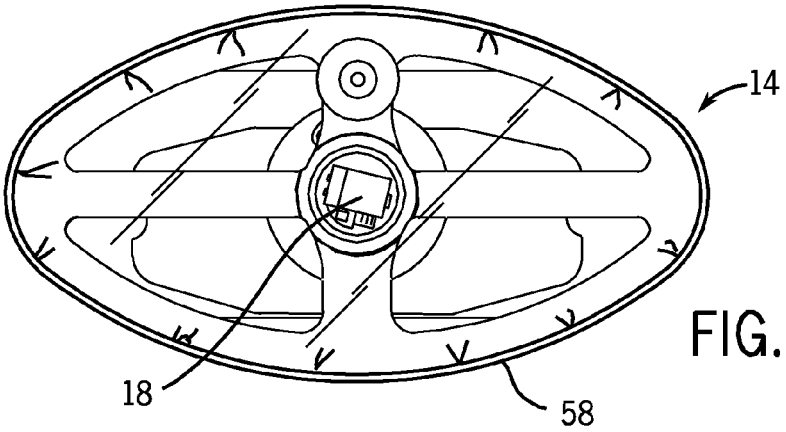

FIGS. 46 through 48 illustrate the bladder 14 in a deflated state following the removal of the second bladder die 240 after the press and RF welding is completed. The excess material of the first and second sheets 62A and B outside of the bladder seam 58 is then removed, and preferably recycled. As in the formation of the pocket 64, in one preferred method, a series of perforations can be formed in the sheets 62A and 62B just outside of the bladder seam 58 to facilitate the trimming or removal of the excess material of the sheets 62A and 62B from the completed bladder 14.

Figure 49:
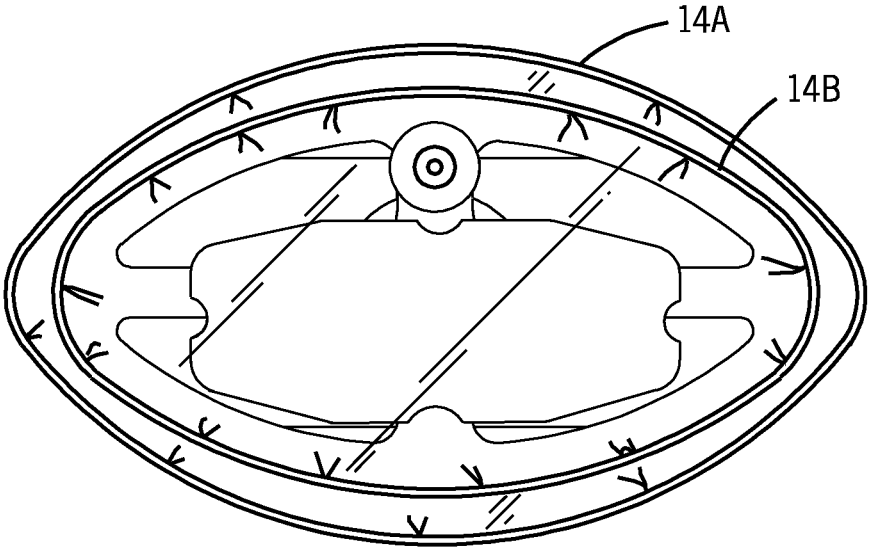
FIG. 49 a side view of two deflated bladders produced in accordance with a preferred method and a preferred embodiment of the present invention.

Referring to FIG. 49, two completed bladders 14A and 14B are shown. The bladders are formed of two different sizes. Both bladders 14A and 14B are configured to be inserted within regulation sized American-style football covers. Once assembled within the football 10, the bladder 14A or 14B within the football 10 expands when inflated and the sheets 62 or outer side walls of the bladder 14A or 14B bear against the lining 40 of the cover 12 of the football 10. The bladder 14A represents a traditionally sized bladder for an Official NFL® Football. The bladder 14B, when measured in a deflated condition, has extends over a two dimension area that is up to 40% smaller than a regulation sized bladder (such as the bladder 14A). In one particularly preferred embodiment, the bladder 14B when deflated extends over a two-dimensional area that is approximately 25% smaller than a regulation sized bladder, such as the bladder 14A. In other preferred embodiments, other predetermined bladder sizes relative to the size of the volume within the cover of a football are contemplated for producing varying amounts or a desired amount of tension onto the cross-member of the bladder.

Because the bladder 14A or 14B takes the shape of the internal surface of the cover 12 when fully assembled and inflated, the size of the bladders 14A and 14B including the cross-members 82 can be used to adjust the tautness or stiffness of the fully assembled bladder 14 within the football 10. The bladder 14B is smaller than the bladder 14A and therefore can expand a greater amount within the football 10 until it bears against the inside of the cover 12. This increased expansion of the bladder 14B, t and the cross-member 82 increases the tension applied to the cross-member 82 as the bladder 14B and the bladder seam 58 expand within the football 10. When the football 10 is pressurized, the stretched or expanded cross-member 82 bonded to the sheets 62 at the bladder seam 58 produces sufficient tension and tautness to the cross-member 82 that the electronic chip 18 remains generally fixed in a predetermined position. The movement of the electronic chip 18 upon shaking or impacting the football 10 is significant reduced by increasing the stiffness, tension, or tautness of the cross-member 82 in this manner. This innovative method of increasing tension on the cross-member 82 by expanding the bladder 14 within the cover 12 of the football 10 provides for the proper and sufficient positioning of the electronic chip 18 within the bladder 14 without having to use heavier materials or adding addition support structure within the bladder or the football to retain the electronic chip in a predetermined position during use.

Figure 50:
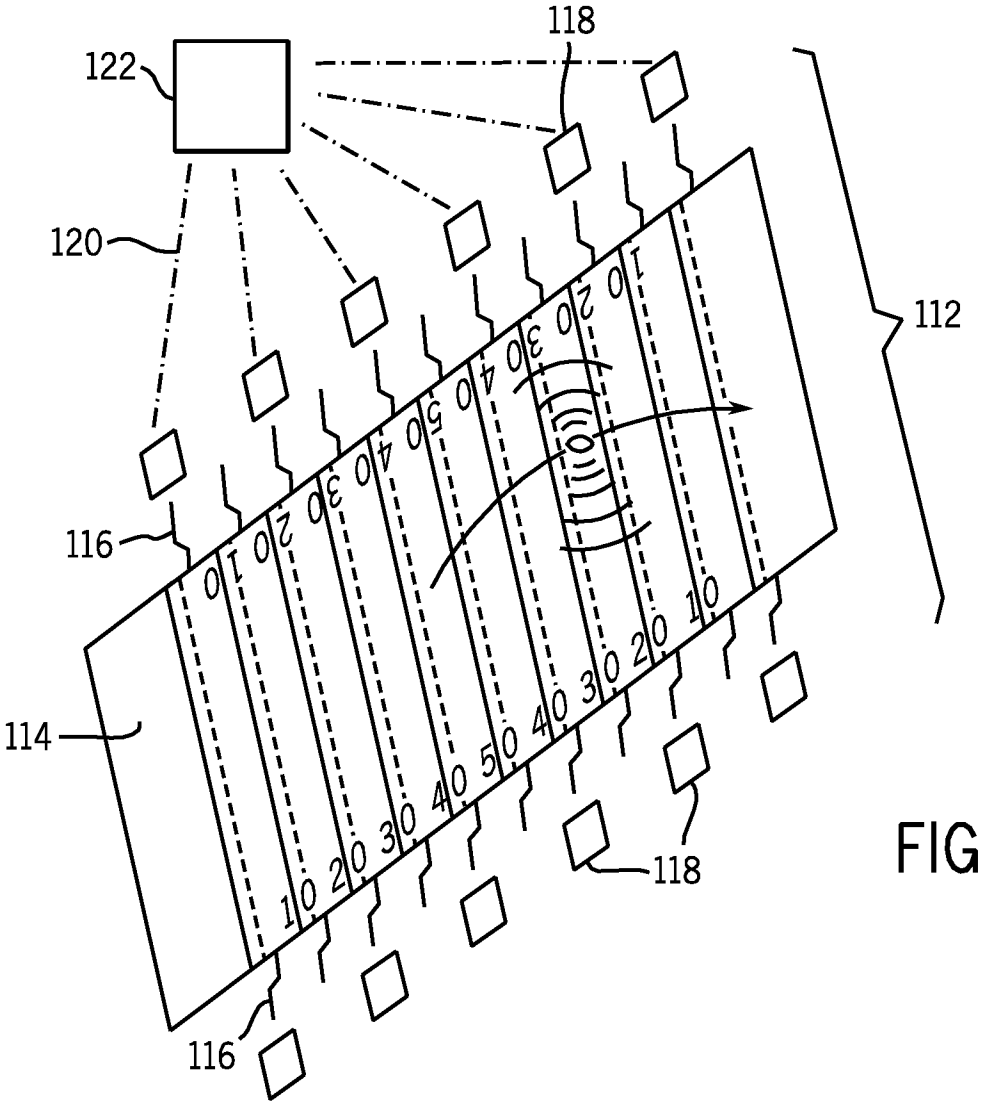
FIG. 50 is a schematic representation of a monitoring system for monitoring a football including electronics in accordance with a preferred embodiment of the present invention.

Referring to FIG. 50, the football 10 can be used in association with a monitoring system 112 that monitors the football 10 over an entire football field 114. The football field 114 can be configured with an array of wires 116 for creating a magnetic field about the football field 114. Preferably, the array of wires 116 are configured to run beneath the football field 114. The array 116 can extend from one side of the field to the other at spaced apart intervals. The intervals can range from being quite small (within inches) to larger distances (100 yards apart or greater). Alternatively the array can take other paths about or beneath the field. A plurality of sensors 118 can be positioned adjacent the array of wires 116 beneath, over or near the football field 114. The sensors 118 also transmit one or more signals 120 representative of data or information relating to changes in the magnetic field due to movement of the football 10 with respect to the field. The signals 120 are received by a receiver 122 which can be coupled to a remote reader, microprocessor, computer, transmitter, server, network of computers and/or the Internet. The sensors 118 and/or the receiver 122 can also process the signal 120 to desired usable information. The monitoring system can be used to monitor, detect and report: the exact position of the football 10 on the football field 114; the movement of the football 10 on and about the football field 114; the speed, acceleration, deceleration, rotation, and path of the football 10; the forces applied to the football 10 during use; the distance traveled by the football 10; and the trajectory of the football 10. The accuracy of the system 112 can be improved by the number and orientation of the array of wires 116 and the number of sensors under, on or about the football field 114. The system 112 can be configured to detect movement of a football 10 on the football field 114 to within the nearest 10 millimeters. In other preferred embodiments, the electronic chip can include a GPS transmitter, receiver and/or transceiver.

The football 10 is configured to enable the electronic chip 18 to work under all foreseeable football game conditions, including rain, snow, mud, cold temperatures and hot temperatures. The football 10 is also configured to perform reliably and accurately throughout play conditions including during and after kick-offs, punts, field goal attempts, passes, tackling and other football activities. The unique positioning of the electronic chip 18 within the football 10 in the embodiments of the present invention allows for the football 10 to withstand all foreseeable game conditions and game-related impacts.

Footballs 10 built in accordance with the present application are specifically configured for providing optimum performance in all levels of competitive, organized play. For example, the footballs built in accordance with the present application fully meet the football rules and/or requirements of one or more of the following basketball organizations: the National Football League ("NFL"); the National Collegiate Athletic Association ("NCAA"); the Football Rules of the National Federation of State High School Associations ("NFHS"); and the Football Rules of the Pop Warner Little Scholars, Inc. Leagues. Accordingly, the term "football configured for organized, competitive play" refers to a football that fully meets the football rules and/or requirements of, and is fully functional for play in, one or more of the above listed organizations.

Footballs built in accordance with the present invention will allow for more information about the game, and in particular the football, to be available to players, coaches, officials, football league representatives and fans. The present invention can be used to significantly improve the accuracy and integrity of official's decisions regarding important game issues such as determining whether the football crossed the goal line during a play and the forward progress of the football during a play. The present invention will enable an official to access such information quickly and easily. Footballs built in accordance with the present invention will also allow for additional important parameters of the football game to be available to officials, players, coaches and fans to improve the entertainment value of the game. The information obtained from footballs of the present invention can be used to provide a potential source of revenue for a football league. Information such as the speed of a thrown football, distance of a thrown or kicked football, etc. can be used to evaluate a player's performance level and can be useful for the growing fantasy football activity.

Footballs built in accordance with the present invention can be used to reduce the number of plays that require a replay review, or can be used to shorten the timeframe used to review a play. The present invention will reduce the likelihood of an incorrect call being made during a game that can improperly affect the outcome of a game. The present invention allows the accurate position of the football 10 to be determined regardless if: the official had the proper view of the play; the replay cameras had a proper angle of the play; the players' bodies obscured the view of the football; and/or the player(s) repositioned the football after the play had been ruled dead.

Footballs built in accordance with the present invention will allow for important data to be communicated to a monitoring system without negatively affecting the play, feel and/or performance of the football. Footballs built in accordance with the present invention will possess the same durability and reliability of existing footballs, and provide the transmission and communication of information relating to the football under different weather conditions including rain, snow, and extreme temperature conditions. These important improvements to a football can be obtained under the present invention without departing from the football's traditional design.

While the preferred embodiments of the present invention have been described and illustrated, numerous departures there from can be contemplated by persons skilled in the art. Therefore, the present invention is not limited to the foregoing description but only by the scope and spirit of the appended claims.

What is claimed is:

1. An American style football having a top side and a bottom side, the football comprising:

an inflatable prolate spheroidal shaped bladder;

at least one cover panel surrounding the bladder;

a lacing coupled to the at least one cover panel on the top side of the football;

a flap coupled to the outer surface of the bladder and generally positioned to align with the lacing, the flap defining an area about the outer surface of the bladder; and an electronic circuit positioned on or beneath the flap and not extending beyond the area defined by the flap, the electronic circuit including at least one sensor and at least one processor, and the electronic circuit being configured to produce a signal to enable at least one characteristic of the football to be monitored during use.

2. The football of claim 1, wherein the at least one characteristic of the football is selected from the group consisting of the football's location, movement, speed, acceleration, deceleration, rotation and temperature, and combinations thereof.

3. The football of claim 1, further comprising a valve coupled to the bladder and wherein the flap is formed of a flexible vinyl and is spaced apart from the valve.

4. The football of claim 1, wherein the flap is formed of a flexible material selected from group consisting of a urethane, an ester urethane, an eva, a thermoplastic material, a polymeric material, rubber, a fabric, leather and combinations thereof.

5. The football of claim 1, wherein the flap is bonded to the bladder through RF welding.

6. The football of claim 1, wherein the bladder defines or includes a pocket, and wherein the electronic circuit is positioned within the pocket.

7. The football of claim 1, wherein the flap defines or includes a flap pocket, and wherein the electronic circuit is positioned within the flap pocket.

8. The football of claim 1, wherein the at least one sensor is selected from the group selected from a pressure sensor, a piezoelectric sensor, a motion sensor, a temperature sensor, and combinations thereof.

9. The football of claim 1, wherein the electronic circuit includes a rechargeable battery.

10. The football of claim 1, wherein the at least one cover panel includes first, second, third and fourth cover panels, wherein the lacing is coupled to the first and fourth cover panels along the cover panel seam between the first and fourth cover panels, and wherein the second and third panels define a back side of the football.

11. The football of claim 1, wherein the electronic circuit has a weight of less than one ounce.

12. An inflatable bladder for an American style football having a cover and a lacing, the bladder comprising:

at least first and second flexible sheets bonded to each other to form an expandable cavity and a bladder seam;

a flap coupled to the outer surface of the bladder and generally positioned to align with the lacing, the flap defining an area about the outer surface of the bladder; and an electronic circuit positioned on or beneath the flap and not extending beyond the area defined by the flap, the electronic circuit including at least one sensor and at least one transmitter, and the electronic circuit being configured to transmit a signal to enable at least one characteristic of the football to be monitored during use.

13. The bladder of claim 12, wherein the football further includes a valve coupled to the bladder, and wherein the flap is spaced apart from the bladder seam and from the valve.

14. The bladder of claim 12, wherein the at least one characteristic of the football is selected from the group consisting of the football's location, movement, speed, acceleration, deceleration, rotation and temperature, and combinations thereof.

15. The bladder of claim 12, wherein the flap is bonded to the bladder through RF welding.

16. The bladder of claim 12, wherein the bladder defines or includes a pocket, and wherein the electronic circuit is positioned within the pocket.

17. The bladder of claim 12, wherein the flap defines or includes a flap pocket, and wherein the electronic circuit is positioned within the flap pocket.

18. The bladder of claim 12, wherein the at least one sensor is selected from the group selected from a pressure sensor, a piezoelectric sensor, a motion sensor, a temperature sensor, and combinations thereof.

19. The bladder of claim 12, wherein the electronic circuit has a weight of less than one ounce.

20. The bladder of claim 12 further comprising a valve assembly, and wherein the flap is spaced apart from the valve assembly.

* * * * *